US009062921B2

(12) United States Patent
Gromes, Sr.

(10) Patent No.: US 9,062,921 B2
(45) Date of Patent: Jun. 23, 2015

(54) APPARATUS, SYSTEM AND METHOD FOR CLEANING HEAT EXCHANGER TUBES

(75) Inventor: Terry D. Gromes, Sr., Navarre, OH (US)

(73) Assignee: Terydon, Inc., Navarre, OH (US)

( * ) Notice: Subject to any disclaimer, the term of this patent is extended or adjusted under 35 U.S.C. 154(b) by 449 days.

(21) Appl. No.: 13/406,014

(22) Filed: Feb. 27, 2012

(65) Prior Publication Data

US 2013/0042894 A1 Feb. 21, 2013

Related U.S. Application Data

(60) Provisional application No. 61/524,127, filed on Aug. 16, 2011.

(51) Int. Cl.

| | |
|---|---|
| ***B08B 3/02*** | (2006.01) |
| ***F28G 15/04*** | (2006.01) |
| ***F28G 15/02*** | (2006.01) |
| ***F28G 1/16*** | (2006.01) |
| ***F28G 15/00*** | (2006.01) |

(52) U.S. Cl.

CPC ..... *F28G 15/04* (2013.01); *B08B 2203/0276* (2013.01); *B08B 3/02* (2013.01); *F28G 15/02* (2013.01); *F28G 1/163* (2013.01); *F28G 15/003* (2013.01)

(58) Field of Classification Search

CPC ..... F28G 3/163; F28G 3/166; F28G 1/163; F28G 1/166; F28G 15/06; F28G 15/04; B65H 2701/33; B64F 1/28; B08B 2203/0276; B08B 3/02

USPC ..... 254/283, 362, 333, 280; 134/167 R

See application file for complete search history.

(56) References Cited

U.S. PATENT DOCUMENTS

| | | | | |
|---|---|---|---|---|
| 2,595,655 | A * | 5/1952 | Hannay | 242/390 |
| 2,823,074 | A * | 2/1958 | Bernard, Jr. | 137/355.17 |
| 6,253,650 | B1 * | 7/2001 | Drei et al. | 82/127 |
| 6,976,649 | B2 * | 12/2005 | Tisbo et al. | 242/395 |
| 7,178,534 | B2 * | 2/2007 | Garman et al. | 134/167 C |
| 7,617,840 | B1 * | 11/2009 | Zinda | 137/355.23 |
| 2009/0255557 | A1 * | 10/2009 | Gardner et al. | 134/18 |
| 2012/0025002 | A1 * | 2/2012 | Zink | 242/390.2 |

FOREIGN PATENT DOCUMENTS

JP 10330046 A * 12/1998

OTHER PUBLICATIONS

Machine translation of JP 10330046 A, dated Dec. 1998.*

* cited by examiner

*Primary Examiner* — Michael Barr
*Assistant Examiner* — Kevin G Lee
(74) *Attorney, Agent, or Firm* — Sand & Sebolt

(57) ABSTRACT

A hose reel assembly, system and method for cleaning tubes, particularly heat exchanger tubes, which system includes independently rotatable inner and outer drums. The inner drum is rotated in a first or second direction by a first motor assembly to wind a hose disposed in a gap between the drums, off of or onto the inner drum. A second motor rotates the outer drum causing rotation of a nozzle on the hose about the hose's longitudinal axis and at speeds of about 100 to about 1600 rpm. The nozzle delivers a water jet at pressures of up to about 55,000 psi to cut through deposits in the bores of the exchanger tubes. The nozzle is mounted on an indexer movable within the heat exchanger and a camera and joystick on a remote console enables an operator to view the cleaning operations and manipulate the nozzle in relative safety.

23 Claims, 20 Drawing Sheets

APPARATUS, SYSTEM AND METHOD FOR CLEANING HEAT EXCHANGER TUBES

CROSS-REFERENCE TO RELATED APPLICATION

This application claims priority from U.S. Provisional Application Ser. No. 61/524,127, filed Aug. 16, 2011, the disclosure of which is incorporated herein by reference.

BACKGROUND OF THE INVENTION

1. Technical Field

This invention relates generally to cleaning devices. More particularly, this invention relates to a device, system and method for cleaning tubes, especially heat exchanger tubes. Specifically, this invention is directed to a hose reel assembly having an inner drum rotatable in one of two directions to wind or unwind a hose disposed in a gap between the inner and outer drums onto or off of the inner drum; and an outer drum rotatable to cause rotation of a nozzle on a hose attached to the assembly about that hose's longitudinal axis and at speeds of about 100 rpm to about 1600 rpm in order to deliver a pressurized jet of water to cut through deposits in the heat exchanger tubes.

2. Background Information

Heat exchangers are devices that transfer heat or cold from one fluid to another. There are several different types of heat exchanger which are used in different applications but one of the more commonly used forms is known as a shell and tube heat exchanger. In this device, there is provided an external shell having an interior chamber within which is disposed a plurality of tubes. The tubes are positioned substantially parallel to each other in a group known in the industry as a tube bundle. Each tube in the tube bundle is surrounded by open space which separates the tube from adjacent tubes. A first fluid is caused to flow through the bores of the tubes and a second fluid is caused to flow through the chamber of the shell in which the tube bundle is situated. If the first fluid is hotter than the second fluid then as the second fluid flows through the chamber and through the spaces surrounding the tubes, heat from the first fluid is transferred to the second fluid. Shell and tube type heat exchangers are designed to maximize the heat transfer between the first and second fluid. Some of the factors that have to be considered in the design of the system are the length of the tubes, the external diameter of the tubes relative to the space surrounding the tubes and the diameter of the bore through each tube. It has been found that longer, thinner tubes offer substantial heat transfer.

One of the issues that these systems experience is that the heated fluid flowing through the tubes tends to deposit impurities onto the interior surfaces of the tube wall that defines the bore. The impurities build up over time and narrow the bore, thus restricting the flow of fluid therethrough. The slowing of the fluid flow tends to accelerate the rate of deposition on the tube walls, restricting the flow even further. This leads to a loss of efficiency in the system. This fouling is especially problematic when long, thin tubes are utilized in the tube bundle.

It is therefore necessary to periodically clean the tubes to remove the built-up substances from the interior surface of the tube's walls. There are several known methods for undertaking this cleaning. In some instances, devices such as small foam balls or other mechanical "blasting-type" materials are placed into the stream of the fluid that will flow through the tubes. These materials scour the interior surfaces, knocking small pieces of built-up substances from the same. In other cleaning methodologies, chemical cleaners are pumped through the tubes to dissolve the build-up. In other instances, drill-type rods are inserted into the tube bores to remove the deposits or high-pressure water jets are used to blast material from the tube's interior surface. The delivery of this high pressure, high velocity water to cut through the deposits presents somewhat of a safety issue for the operators of the machinery accomplishing the cleaning. The narrowness or even blockage of the bores of some of the tubes can cause the water jet to be deflected back toward the operator, potentially injuring him or her. There is also a tendency for the water jet to simply cut a channel through the built-up material instead of scouring the interior surfaces of the tube clean.

There is therefore a need in the art for an improved device for cleaning heat exchanger tubes using a high pressure, high velocity water jet that quickly and efficiently scours substantially the entire interior surface of a heat exchanger tube while doing so in a safe manner for the operator of the cleaning device.

BRIEF SUMMARY OF THE INVENTION

The present invention comprises a hose reel assembly, system and method for cleaning tubes, particularly heat exchanger tubes. The assembly includes an inner drum and outer drum which are independently rotatable. The inner drum is rotated in a first or second direction by a first motor assembly to wind a hose disposed in a gap between the inner and outer drums, off of or onto the inner drum. A second motor rotates the outer drum causing rotation of a nozzle on the hose about the hose's longitudinal axis and at speeds of about 100 rpm to about 1600 rpm. The nozzle delivers a water jet at pressures of up to about 55,000 psi to cut through deposits in the bores of the exchanger tubes. The nozzle is mounted on an indexer movable within the heat exchanger and a camera and joystick on a remote console enables an operator to view the cleaning operations and manipulate the nozzle in relative safety.

In accordance with a first aspect of the present invention there is disclosed a hose reel assembly for cleaning tubes, particularly heat exchanger tubes, said assembly comprising a base, an inner drum mounted on the base, an outer drum mounted on the base and surrounding the inner drum, a gap defined between a longitudinally aligned peripheral wall of the inner drum and a longitudinally aligned peripheral wall of the outer drum; and wherein the gap is adapted to receive a length of hose therein, a first motor assembly operationally engaged with the inner drum; and wherein said first motor assembly is selectively operable to rotate the inner drum about a longitudinal axis in one of a first direction and a second direction; and a second motor operationally engaged with the outer drum, and wherein said second motor is selectively operable to rotate the outer drum about the longitudinal axis.

In accordance with a second aspect of the present invention, there is disclosed a system for cleaning tubes, particularly in a heat exchanger, said system comprising a hose reel assembly for cleaning heat exchanger tubes, said assembly comprising a base, an inner drum mounted on the base, an outer drum mounted on the base and surrounding the inner drum, a gap defined between a longitudinally aligned peripheral wall of the inner drum and a longitudinally aligned peripheral wall of the outer drum; and wherein the gap is adapted to receive a length of hose therein, a first motor assembly operationally engaged with the inner drum; and wherein said first motor assembly is selectively operable to rotate the inner drum about a longitudinal axis in one of a first direction and a second direction; a second motor operationally engaged with the outer drum, wherein said second motor is selectively operable to rotate the outer drum about the longitudinal axis in a first direction; a hose secured at a first end to the outer drum and including a section that extends outwardly from both of the inner and outer drums and terminates in a second end; and wherein said inner drum is selectively rotatable in a first direction to wind at least a portion of the hose onto the peripheral wall of the inner drum and into the gap between the inner and outer drums, and the inner drum is selectively rotatable in a second direction to wind the hose off of the peripheral wall of the inner drum and out of the gap; and a nozzle engaged with the second end of the hose; and wherein the outer drum is selectively rotatable in the first direction to cause the nozzle to rotate about a longitudinal axis of the hose. A groove is defined on an interior surface of the outer drum to receive the hose. The groove substantially prevents the hose from becoming entangled and provides the directing force which gives a linear transversing motion to the hose. Basically, the outer drum is like a nut with an internal thread and the hose acts like the exterior thread of a bolt, where the bolt is the inner drum. When the inner drum (the bolt) rotates in one direction, its threads (the hose) move in the opposite direction, thereby causing the linear motion of the hose which extends out of the hose reel assembly. Thus, when the inner drum is rotated in a first direction, it forces the hose to be retracted or wound up into groove and when the inner drum is rotated in a second direction it forces the hose to be unwound from the groove and extended outwardly from the hose reel assembly.

In accordance with a third aspect of the present invention, there is disclosed a method of cleaning tubes, particularly heat exchanger tubes, comprising the steps of:

- positioning a nozzle of a hose extending outwardly from a hose reel assembly adjacent an opening to a bore of a tube to be cleaned;
- activating a motor on the hose reel assembly;
- rotating an outer drum on the hose reel assembly by way of the actuated motor;
- rotating the nozzle of the hose about a longitudinal axis of the hose by way of the rotating drum;
- directing a pressurized water jet from the nozzle and into the opening of the heat exchanger tube; and
- removing built-up deposits from a wall of the tube that defines the bore by way of the water jet.

The method further includes the steps of:

- activating a first motor assembly on the hose reel assembly;
- rotating an inner drum disposed within a chamber of the outer drum about a longitudinal axis and in a first direction using the first motor assembly;
- unwinding a selected length of hose including the second end thereof from within a gap between the inner and outer drums by way of the rotating inner drum;
- advancing the rotating nozzle on the hose through the bore of the tube as deposits are cut away therefrom; and
- deactivating the first motor assembly.

The method further includes the steps of:

- activating the first motor assembly;
- rotating the inner drum about the longitudinal axis and in the second direction using the first motor assembly;
- winding a selected length of hose into the gap between the inner and outer drums and about a peripheral wall of the inner drum; by way of the rotating inner drum;
- removing the rotating nozzle from the bore of the first selected tube once all deposits have been removed therefrom;
- positioning the rotating nozzle adjacent an opening to a second selected tube to be cleaned; and
- directing the pressurized water jet from the nozzle into the opening of the second selected tube; and
- removing built-up deposits from an interior wall of the second selected tube.

The method further includes the steps of:

- capturing images of the nozzle and the openings to the heat exchanger tubes on a camera mounted on the indexer;
- transmitting the images to a display screen on a remote controller console; and
- manipulating the positioning of the nozzle using a joystick mounted on the remote controller console.

The method further includes the steps of:

- moving the indexer from a first region of tubes to be cleaned to a second region of tubes to be cleaned.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
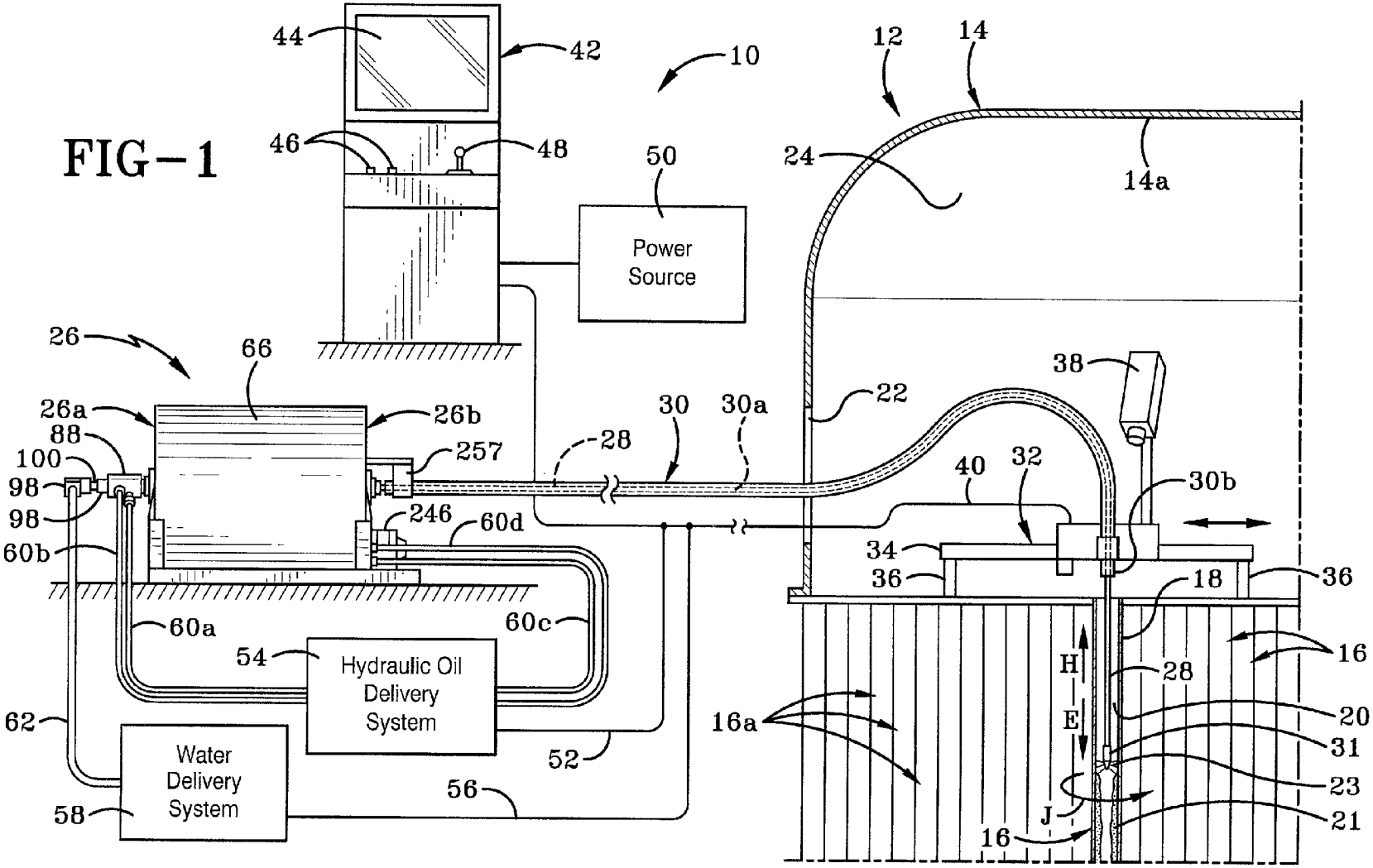
FIG. 1 is a schematic view of a system for cleaning tubes, particularly heat exchanger tubes, and incorporating a hose reel assembly in accordance with the present invention.

Referring to FIG. 1, there is shown a system 10 for cleaning a heat exchanger 12. Heat exchanger 12 includes a housing 14 in which is disposed a plurality of heat exchanger tubes 16. For the sake of clarity, the spaces between tubes 16 have been omitted. Tubes 16 are disposed proximate each other and are aligned in parallel with one another. Each tube 16 comprises an elongated tubular wall 18 which bounds and defines a longitudinal bore 20 therein. Over time, the bores 20 of tubes 16 tend to become clogged with deposits 21 that build up along the interior surface of wall 18. System 10 is configured to shoot a high-pressure jet of water into the opening at one end of each tube 16 to scour these deposits 21 from the interior surface of wall 18 and to flush the removed debris out of the other end of the tube. Preferably, the water jet 23 (FIG. 1) is introduced into an opening at the upper end of each tube 16 and the removed deposits are flushed from the bottom end or top end thereof, depending on the position of nozzle 31 and the blockage of deposits in tube 16. It will be understood that the device of the present invention may be utilized to clean any type of tube disposed in any orientation. The description herein of cleaning heat exchanger tubes is made by way of example only and should not be construed as limiting the invention in any way.

In accordance with a feature of the present invention and as will be described later herein, system 10 is configured to rotate the water jet 23 through 360° within the wall 18 of tube 16 so as to scour deposits 21 from substantially the entire interior surface of wall 18.

Housing 14 of heat exchanger 12 defines an opening 22 therein and a space 24 is defined between the upper ends of tubes 16 and an interior surface 14*a* of housing 14. The size of opening 22 is relatively small, as is the clearance between upper ends of tubes 16 and interior surface 14*a*. It is into this opening 22 and space 24 that a workman will have to insert much of the equipment of system 10 to clean and flush tubes 16.

In accordance with a specific feature of the present invention, system 10 includes a hose reel assembly 26 onto which is mounted a flexible hose 28 useful for transporting and delivering the water from a water delivery system 54 to the upper ends of tubes 16. Hose reel assembly 26 is connected to a water supply and is configured to wind hose 28 onto and off of a drum as will be hereinafter described. Furthermore, at least a portion of hose reel assembly 26 is configured to rotate at a high rate of speed so as to cause a nozzle 31 on hose 28 to rotate through 360° so as to cause the water jet 23 emitted from nozzle 31 to move through 360° to completely scour the interior surface of tube 16.

System 10 further includes an indexer 32 that is used to position the nozzle-end of hose 28 over the upper ends of a selected group of tubes 16. Indexer 32 is moved from region to region of heat exchanger 12 so as to ensure all tubes 16 therein are cleaned. System 10 further includes a controller console 42 used to remotely guide and control hose 28 during the cleaning process. All of these components of system 10 will be further described herein.

Referring to FIGS. 1-16, hose reel assembly 26 includes a hose reel that has a front end 26*a*, a rear end 26*b* and a cover 66 extending therebetween. Hose reel includes an outer drum 112 (FIG. 4) and an inner drum 187 (FIG. 12) that are separately and independently rotatable in either of a first and a second direction. Flexible hose 28 is wound onto or off of inner drum 187 and extends outwardly from rear end 26*b* of the hose reel. A length of protective tubing 30 having a longitudinal bore 30*a* therethrough is engaged with hose reel assembly 26 and is engaged with indexer 32. Flexible hose 28 extends through bore 30*a* of tubing 30 and a free end thereof extends through the indexer-engaged end of tubing 30 and terminates in nozzle 31. Indexer 32 includes a platform 34 having a plurality of legs 36 that are releasably engaged with the upper ends of a first group 16*a* of spaced apart tubes 16. Indexer 32 is configured to retain nozzle 31 in a generally vertical orientation so that the opening in the nozzle 31 will be disposed a short distance from the opening to bore 20 of one of the tubes 16. Nozzle 31 is retained a short distance from the opening to bore 20 by platform 34 to reduce a splash-back effect when water 23 is shot at high pressure out of nozzle 31 and into bore 20 of tube 16. If nozzle 31 is retained too close to the opening to bore 20 when the jet of water 23 contacts deposits 21 within bore 20, some of the water will be deflected back toward the opening. This is especially true if debris is located close to the opening. If nozzle 31 is too far from the opening to bore 20, then the pressure of the jet of water 23 will be decreased because water exiting nozzle 31 will tend to fan slightly outwardly away therefrom. So, instead of shooting a single high pressure stream into the bore 20 of one tube, some of the water jet 23 could spread outwardly and enter into the bores 20 of adjacent tubes 16.

As indicated previously, heat exchanger 12 includes a large number of tubes 16 therein and indexer 32 is positioned adjacent a first region of the exchanger 12 where a first plurality of tubes 16*a* is disposed. Once those tubes 16*a* are cleaned, indexer 32 is moved to a second region of the exchanger 12, shown in FIG. 1, where a second plurality of tubes 16 is disposed. When the tubes 16 in the second region are cleaned, the indexer 32 will be moved to a third region of the heat exchanger 12 and so on until ultimately, all of the tubes are cleaned. Indexer 32 may be physically moved from the first region to the second region by a workman extending at least a portion of his body through opening 22. Alternatively, indexer 32 may be provided with a suitable mechanical mechanism to relocate it within space 24 of indexer 32 and to move the indexer from region to region.

A camera 38 is mounted on indexer platform 34, and platform 34 and/or camera 38, is wired via electrical circuitry 40 back to controller console 42. Camera 38 allows the operator to watch the cleaning operation and to make adjustments as necessary from a safer remote location. Controller console 42 includes a display screen 44, control buttons 46 and a joy stick 48. Controller console 42 is shown connected to a power source 50. Power source 50 can be any suitable form of power such as AC current accessible through an outlet (not shown) or may be a battery (not shown) housed internally within controller console 42. Controller console 42 is connected by electrical, pneumatic or hydraulic circuitry 40, 52 to a hydraulic oil delivery system 54 and by electrical, pneumatic or hydraulic circuitry 40, 56 to a water delivery system 58. Hydraulic oil delivery system 54 is connected by a pair of lines 60*a*, 60*b* to a pair of hydraulic motors 146, 148 on hose reel assembly 26 by way of a hydraulic swivel 88. Hydraulic oil delivery system 54 is also connected via lines 60*a*, 60*b* to a motor 246 mounted on hose reel assembly 26. The structure and operation of these components will be further described later herein. Water delivery system 58 is connected by a line 62 to fitting 98 on hose reel assembly 26 and then via fitting 98 and a first portion 76 of a central shaft to hose 28. Camera 38 enables the operator at controller console 42 to see nozzle 31 extending from indexer 32 so that he can make necessary adjustments to the position of nozzle 31 relative to the group of tubes 16, adjust the height of the nozzle relative to the opening of bore 20 of a selected tube 16, adjust the rotation speed of nozzle 31, and adjust the speed of rotation of inner and outer drums 188, 112 as needed. All of these operations will be described later herein.

It will be understood that when hose reel assembly 26 is to be used to clean the bore of a tube 16, nozzle 31 may be positioned adjacent a top opening to the bore and the water will be blasted downwardly into the bore and the hose will be fed downwardly as the nozzle advances through tube 16. Alternatively, nozzle 31 may be positioned adjacent a bottom opening to the bore and the water will be blasted upwardly into the bore with the hose being fed upwardly through the bore as nozzle 31 advances. In the following description and in the attached drawings pertaining thereto, the nozzle 31 is illustrated as being disposed adjacent the top opening to the bore but it should be understood that the alternative arrangement with the nozzle 31 disposed at the bottom opening to the bore is also considered to be within the scope of the present invention. Still further, tube 16 could be disposed horizontally or at any angle and the device of the present invention could be utilized to clean the same.

Hose reel assembly 26 is shown in greater detail in FIGS. 2-16. Hose reel assembly 26 includes a base 64 comprised of first and second side members 64*a*, 64*b*; and front and back members 64*c*, 64*d*. Base 64 further includes four vertical legs 61 disposed at the corners of base where first and second side members 64*a*, 64*b* connect to front and back members 64*c*, 64*d*. Vertical legs 61 extend upwardly from the corners. Base 64 further includes a front frame member 63*a* that extends horizontally between the upper ends of the two front legs 61, and a back frame member 63*b* that extends horizontally between the upper ends of the two back legs 61.

Figure 2:
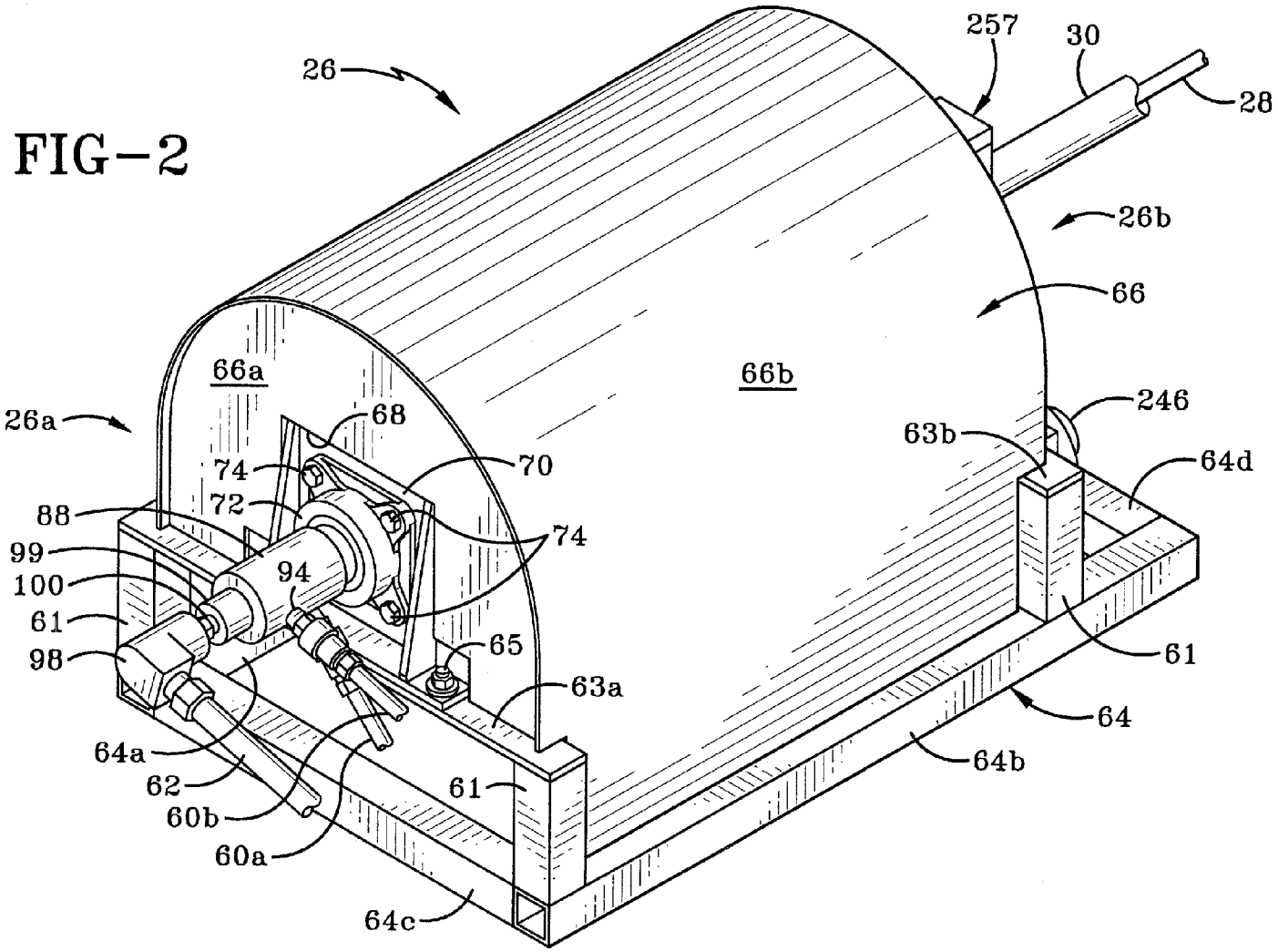
FIG. 2 is a perspective front view of the hose reel assembly in accordance with the present invention.

Referring to FIG. 2, a cover 66 is provided on hose reel assembly 26 to protect the components within the interior thereof and to prevent workers from getting hurt if they accidentally come into contact with the outer drum 112 when it is rotating. Preferably, cover 66 is made from a steel mesh type of material. Cover 66 has a generally planar and vertically oriented front end 66*a* that engages front frame member 63*a* and extends vertically upwardly therefrom. Cover 66 further includes a back end (not shown in this figure) that is also generally planar and vertically oriented and engages back frame member 63*b* and extends vertically upwardly therefrom. Finally, cover 66 includes a generally semi-circular intermediate wall 66*b* that extends between front end 66*a* and back end of cover and between first and second side members 64*a*, 64*b* of base 64. Cover 66 may be secured to base 64 by any suitable means.

Front end 66*a* of cover defines a generally square aperture 68 therein that is complementary sized and shaped to receive a first bearing plate 70 therein. First bearing plate 70 is mounted to an upper surface of front frame member 63*a* by nuts and bolts 65. A bearing 72 is mounted onto a front surface of first bearing plate 70 by way of a plurality of bolts 74. A first region of first portion 76 of central shaft of hose reel assembly 26 extends outwardly through an aperture 78 in bearing 72 and into engagement with hydraulic swivel 88. Shaft 76 is disposed substantially at right angles to front end 66*a* of cover 66, is oriented generally horizontally and is aligned along a longitudinal axis "Y" (FIG. 3) of hose reel assembly 26. Bearing 72 enables shaft 76 to rotate without imparting rotational motion to bearing plate 70 or cover 66.

Figure 3D:
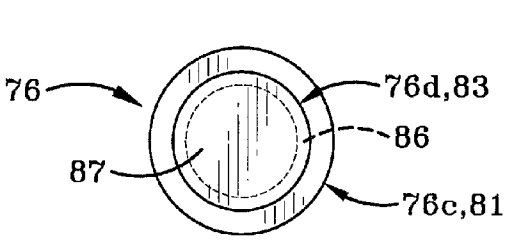
FIG. 3D is a rear view of a second end of the central shaft.
Figure 3A:
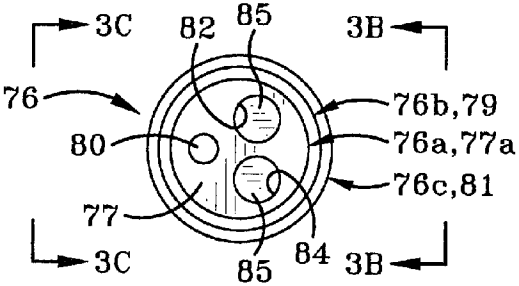
FIG. 3A is a front view of a first end of the central shaft.
Figure 3B:
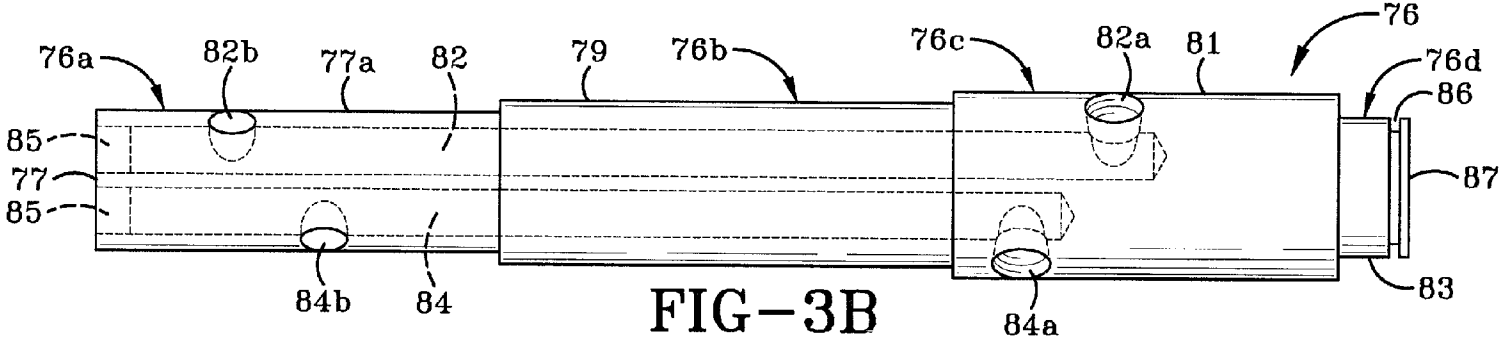
FIG. 3B is a side view of a first side of the central shaft.
Figure 3C:
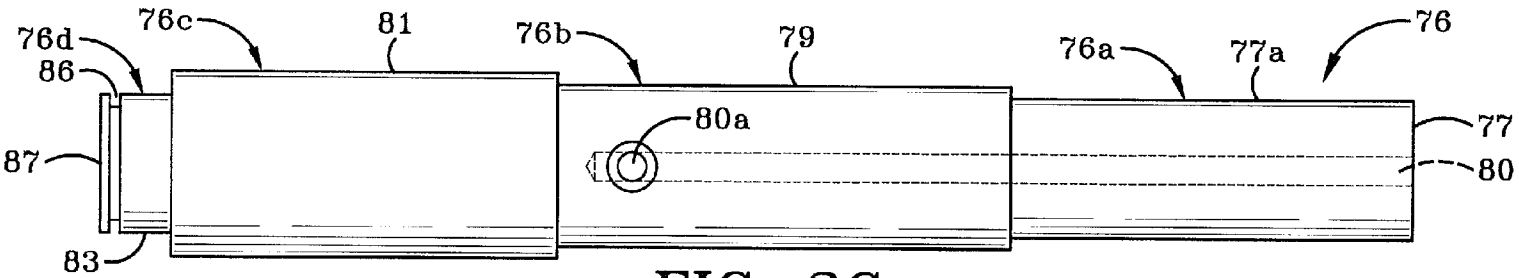
FIG. 3C is a side view of a second side of the central shaft.
Figure 4:
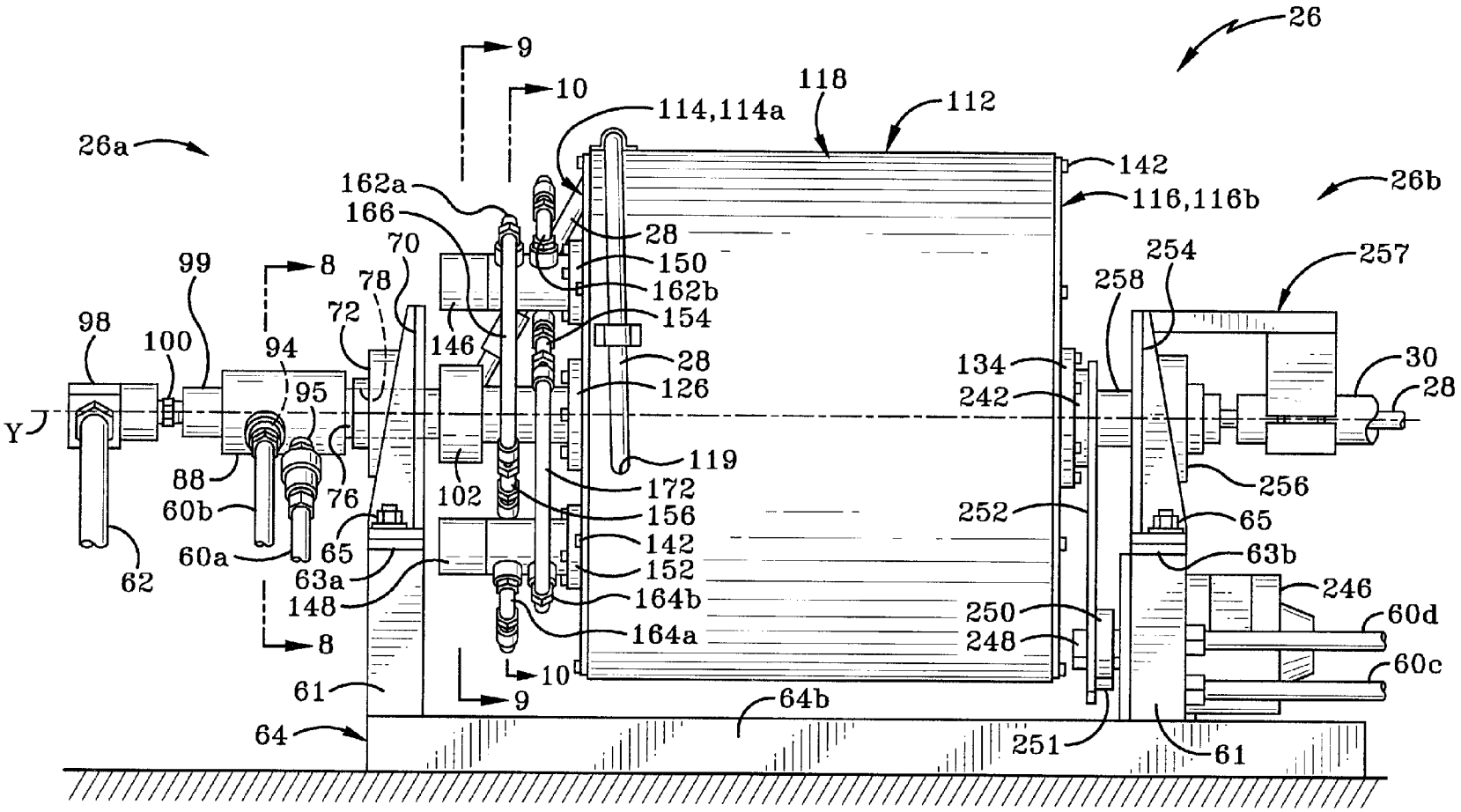
FIG. 4 is a side elevational view of the hose reel assembly of FIG. 2 with the cover removed therefrom.
Figure 5:
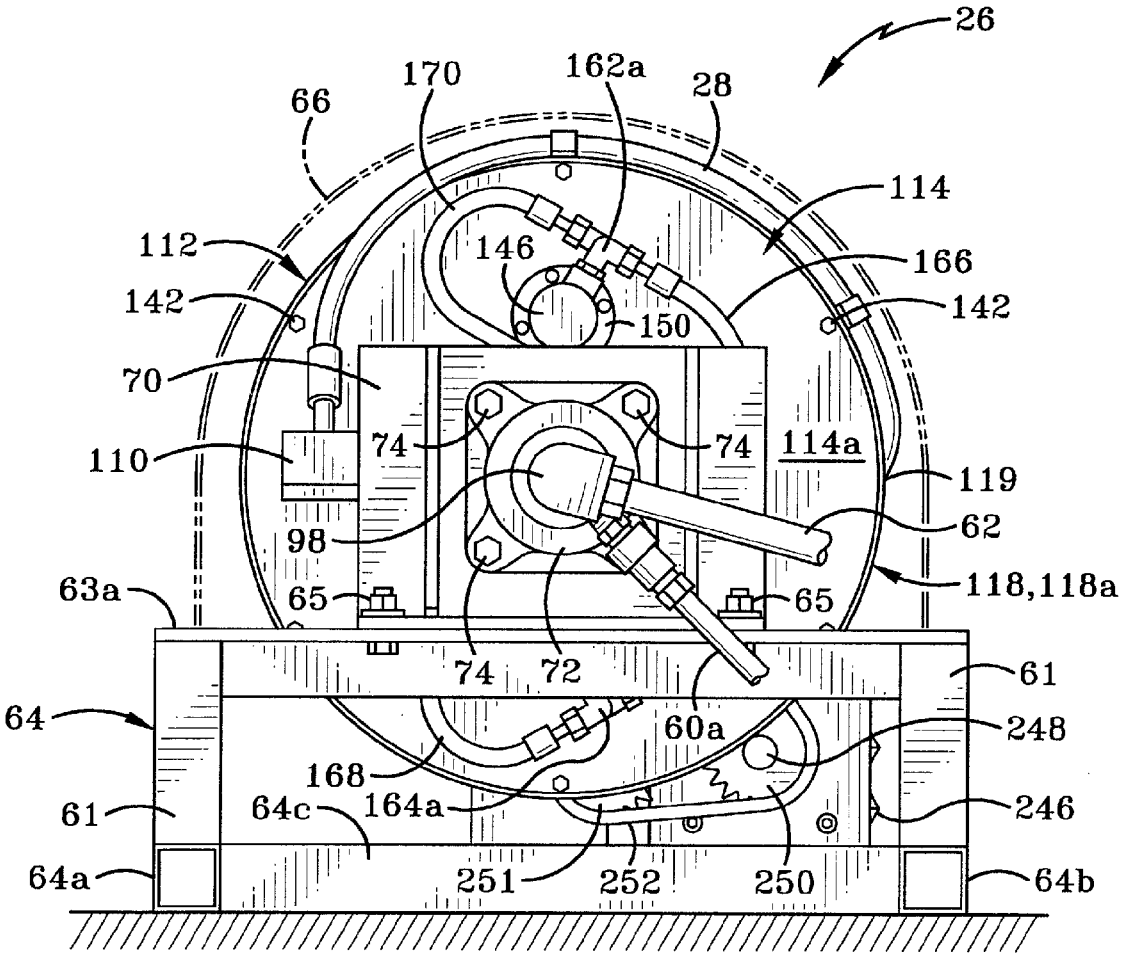
FIG. 5 is front elevational view of the hose reel assembly with the cover shown in phantom.
Figure 6:
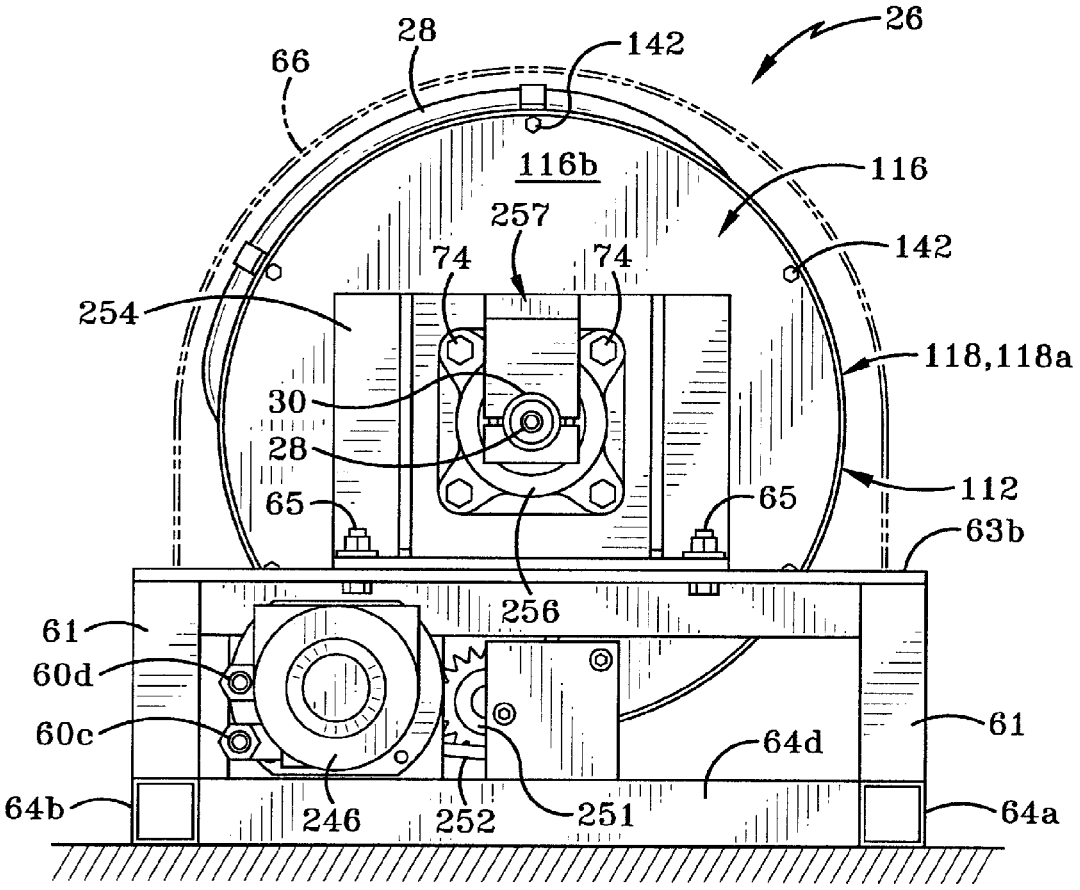
FIG. 6 is a rear view of the hose reel assembly with the cover shown in phantom.
Figure 7:
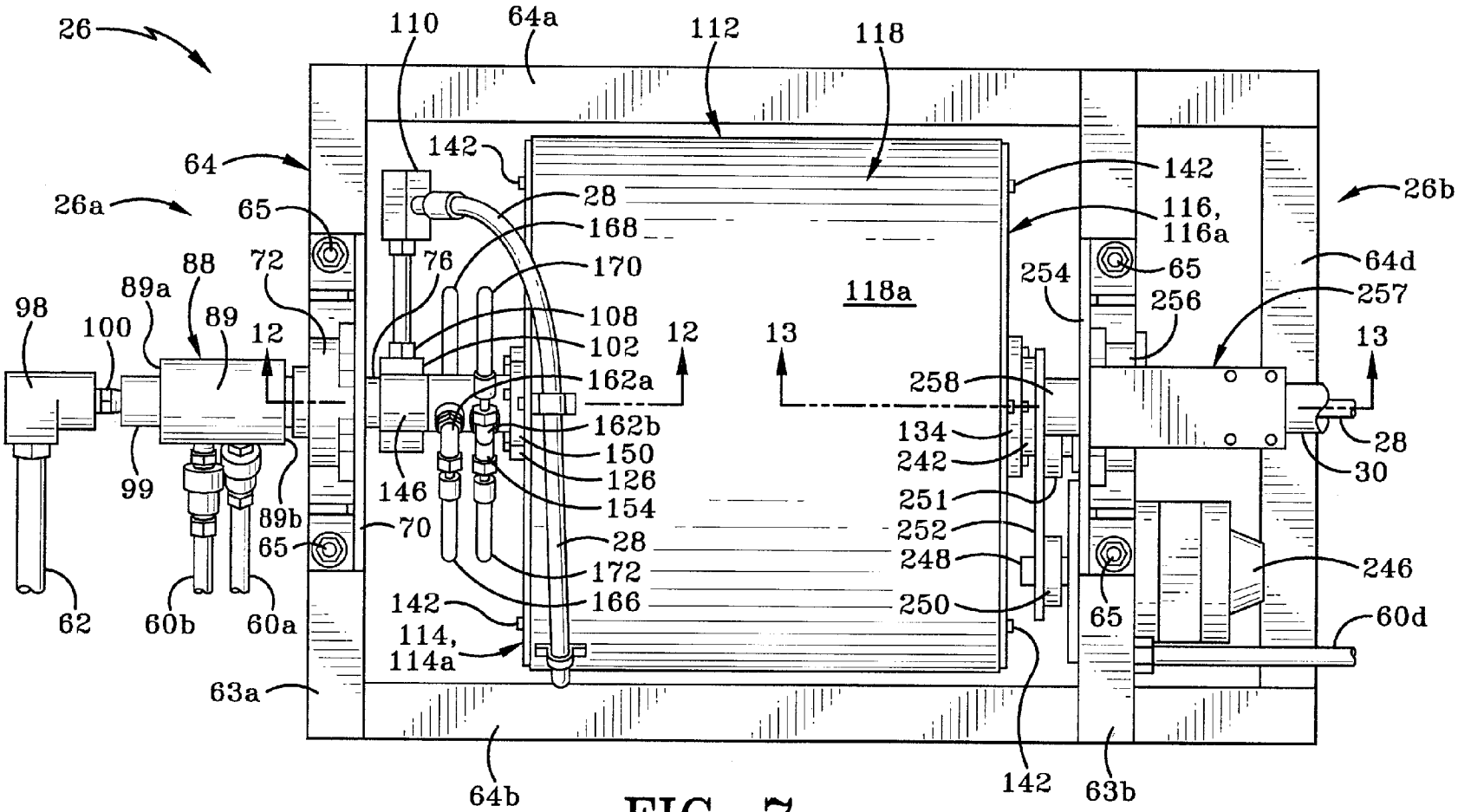
FIG. 7 is a top view of the hose reel assembly shown in FIG. 4.

Shaft 76 is shown in greater detail in FIGS. 3*a*-3*c*. Shaft 76 comprises a generally solid cylindrical member and defines a first region 76*a*, a second region 76*b*, a third region 76*c*, and a fourth region 76*d* along its length and between its first end 77 (shown in FIG. 3A) and rear end 87 (shown in FIG. 3D). Shaft 76 is configured to rotate about longitudinal axis "Y" of hose reel assembly 26 during operation thereof. First region 76*a* is of a first cross-sectional diameter, second region 76*b* of a second cross-sectional diameter, third region 76*c* of a third cross-sectional diameter and fourth region is of a fourth cross-sectional diameter. The fourth diameter of fourth region 76*d* is the smallest, and the third diameter of third region 76*c* is the largest. Second diameter of second region 76*b* is smaller than the third diameter and is larger than the first diameter of first region 76*a*. Each of the first, second, third and fourth regions 76*a*-76*d* extends through and/or engages a different component in hose reel assembly 26. First region 76*a* extends through hydraulic swivel 88, second region 76*b* extends through bearing 72 and first bearing plate 70, and third region 76*c* extends through a take-off fitting 102. Finally, fourth region 76*d* extends through mounting plate 126, through first drum plate 114 of outer drum 112, through bearing 190 and through apertures in gear 186 and first inner drum plate 187.

Referring to FIGS. 3A-3D, and in accordance with yet another feature of the present invention, first portion 76 of central shaft defines a first bore 80, a second bore 82, and a third bore 84 therein. Bores 80, 82, 84 extend inwardly into shaft 76, running substantially parallel to longitudinal axis "Y" of hose reel assembly 26. Bore 80 is configured to carry water and extends from first face 77, through first region 76*a* of shaft 76 and into second region 76*b* thereof. First region 76*a* has a peripheral wall 77*a* and second region has a peripheral wall 79. Bore 80 terminates in a radially-extending opening 80*a* (FIG. 3C and FIG. 9) in peripheral wall 79 of second region 76*b*. The opening to bore 80 at first face 77 is in fluid communication with fitting 98 via end portion 99 of swivel 88 and water flows from water line 62, through fitting 98, through end portion 99 and into bore 80.

Bores 82, 84 are both configured to carry hydraulic oil. Bore 82 originates at first face 77 but is closed off at first face 77 by a plug 85 (FIG. 3B). A radially-extending opening 82*b* is provided in peripheral wall 77*a* of first region and opening 82*b* is in communication with bore 82. Bore 82 extends through first region 76*a*, through second region 76*b* and into third region 76*c*, terminating at a radially-extending opening 82*a* in peripheral wall 81 of third region 76. Plug 85 is provided to prevent hydraulic oil from flowing out of bore 82 at first face 77. Thus, hydraulic oil flowing through bore 82 will only be able to flow between openings 82*a* and 82*b*.

Bore 84 originates at first face 77 but is also close off at first face 77 by a plug 85 to prevent hydraulic oil from flowing out of the same. A radially extending opening 84*b* (FIG. 3B) is provided in peripheral wall 77*a* spaced from opening 82*b* both longitudinally and circumferentially. Opening 84*b* is in communication with bore 84. Bore 84 extends through first region 76*a*, through second region 76*b* and into third region 76*c*, terminating at a radially extending opening 84*a* in peripheral wall 81 of third region 76. Again, opening 84*a* is spaced both longitudinally and cir circumferentially from opening 82*a*.

The peripheral wall 83 of fourth region 76*d* defines an annular groove 86 in the external surface thereof proximate a substantially solid end face 87. Groove 86 is oriented substantially at right angles to longitudinal axis "Y" of hose reel assembly 26.

Figure 8:
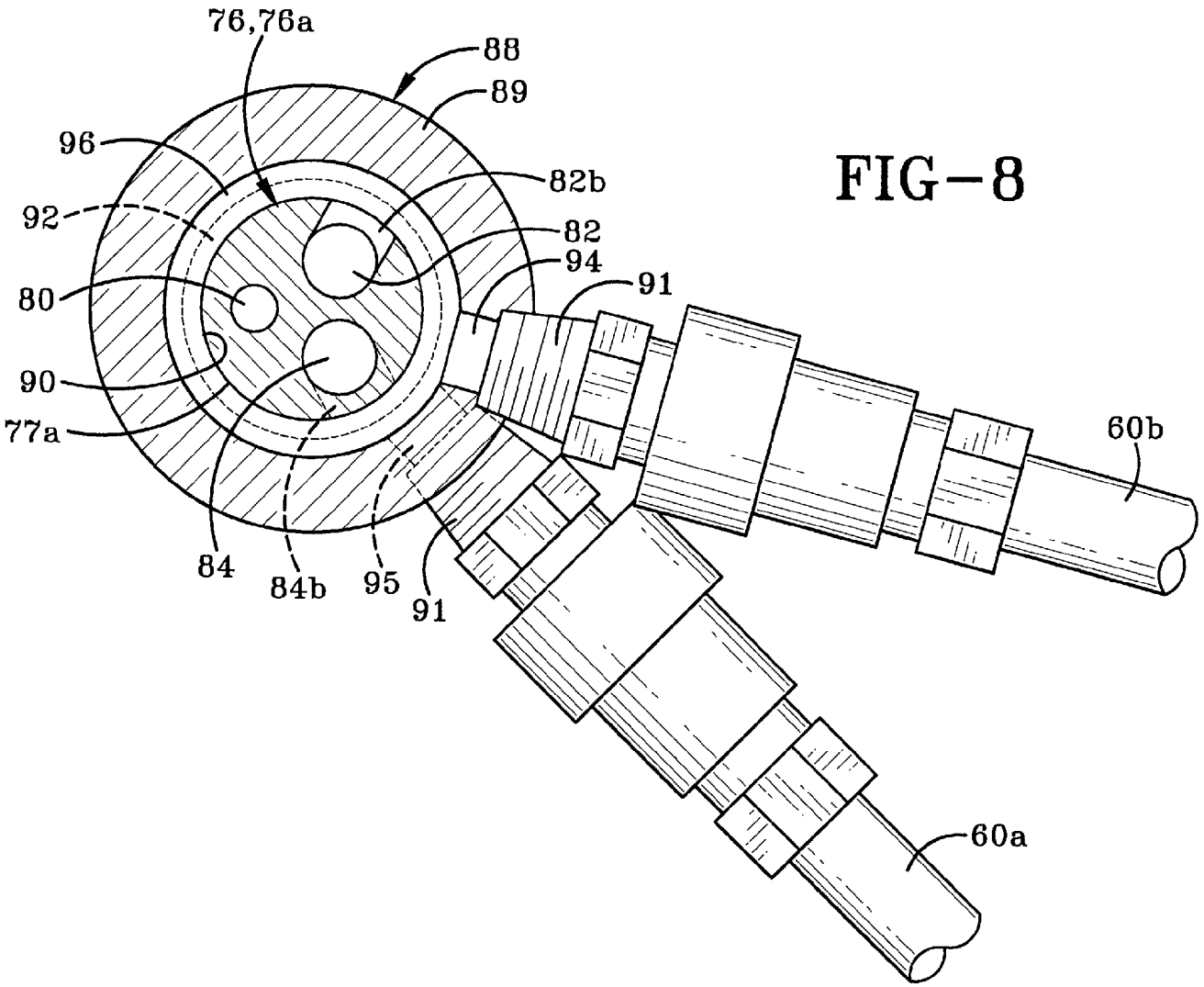
FIG. 8 is a cross-sectional front view of the first end of the hydraulic swivel and central shaft taken through line 8-8 of FIG. 4.

As indicated above, first region 76*a* of first portion 76 of central shaft engages hydraulic swivel 88. Hydraulic swivel 88 is a generally cylindrical member including a peripheral wall 89 (FIG. 8) that defines a longitudinal bore 90 therein. First portion 76 of central shaft is received within this bore 90 and an O-ring (not shown) is provided around first portion 76 of central shaft at each end of bore 90, i.e., adjacent first end 89*a* (FIG. 7) and second end 89*b* of swivel. The O-rings are provided to seal the ends of bore 90 so that hydraulic fluid will not flow outwardly therefrom. A third O-ring 92 (FIG. 8) is provided around first portion 76 of central shaft in a location that falls between a first radial passageway 94 and a second radial passageway 95. First and second passageways 94, 95 extend from an exterior surface of swivel 88 to bore 90. FIG. 8 is a cross-section through swivel 88 taken at a location aligned through first passageway 94. As is evident from this figure, swivel 88 further defines a first annular groove 96 that operationally connects first passageway 94 to opening 82*b* in first portion 76 of central shaft. Although not illustrated herein, it should be understood that a cross-sectional view of swivel 88 taken at a location aligned through second passageway 95 would reveal a second annular groove that is substantially identical to first annular groove 96 but operationally connects second passageway 95 to opening 84*b* in first portion 76 of central shaft. The first groove 96 is distinct from the second groove and is separated therefrom by the third O-ring 92, i.e., that O-ring which is disposed between first and second passageways 94, 95. Hydraulic oil which flows out of first hydraulic line 60*a*, through second passageway 95, into the second groove, will then flow into bore 84 of first portion 76 of central shaft. Hydraulic oil which flows out of second hydraulic line 60*b*, through first passageway 94, into the first groove 96, will then flow into bore 82 of first portion 76 of central shaft. The fluid pathway of the hydraulic fluid may be reversed, i.e., with oil flowing out of bores 82, 84 in first portion 76 of central shaft, into first groove 96 and second groove (not shown), through second and first passageways, 94, 95 and into fluid lines 60*b*, 60*a*, respectively. No intermingling of the hydraulic oil from first and second hydraulic lines 60*a*, 60*b* will occur in swivel 88. The first passageway 94 and second passageway 95 are spaced a distance longitudinally and circumferentially from each other on peripheral wall 89 and each one is configured to receive a threaded connector 91 of one of the first and second hydraulic lines 60*a*, 60*b* therein.

In accordance with yet another feature of the present invention, a connector 100 from fitting 98 is engaged with end portion 99 of hydraulic swivel 88. Although not illustrated herein, it should be understood that end portion 99 defines an aperture therethrough that is in fluid communication with bore 90. When first portion 76 of central shaft is received in bore 90, the aperture in end portion 99 is in fluid communication with bore 80 of first portion 76 of central shaft. Fitting 98 engages water line 62 and water is able to flow from water delivery system 58, through line 62, through fitting 98, through connector 100, into the aperture in end portion 99 of hydraulic swivel 88, and into bore 80 of first portion 76 of central shaft.

Figure 9:
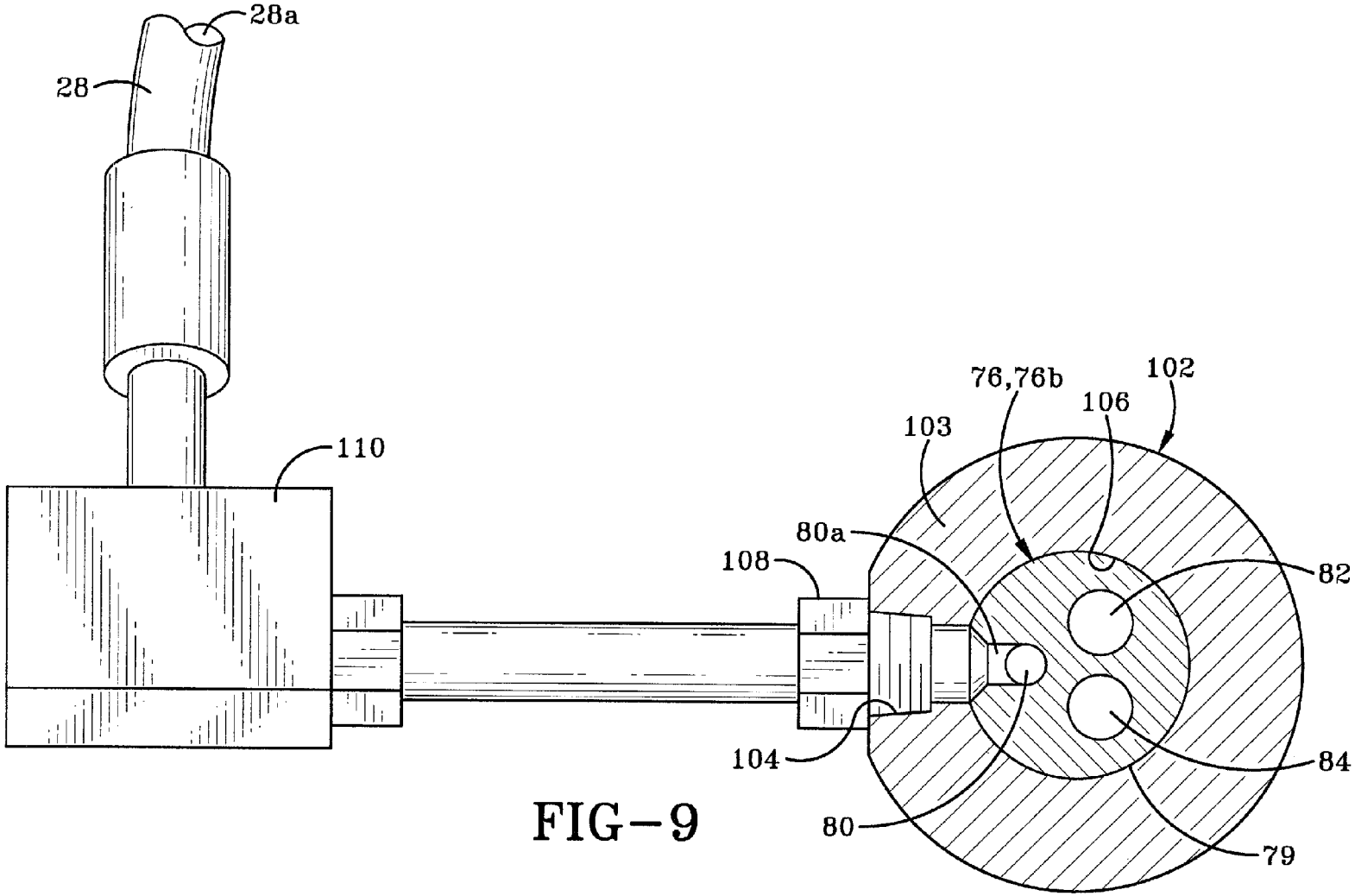
FIG. 9 is a partial cross-sectional front view of central shaft and the water take-off fixture engaged therewith taken through line 9-9 of FIG. 4.

Referring to FIG. 9, there is shown a cross-section through fitting 102 which is engaged with third region 76*c* of shaft 76. Fitting 102 includes a peripheral wall 103 which defines a bore 106 therein and through which second section 76*b* of first portion 76 of central shaft extends. Fitting 102 defines a passageway 104 that extends from an exterior surface of peripheral wall 103 to bore 106. Passageway 104 is configured to be in fluid communication with opening 80*a* in first portion 76 of central shaft. This puts passageway 104 in fluid communication with bore 80. A threaded connector 108 of a diverter 110 is threadably engaged in passageway 104. A first end of flexible hose 28 is permanently and fixedly secured to diverter 110. Consequently, hose 28 is in fluid communication with bore 80 of first portion 76 of central shaft. A portion of hose 28 passes over a region of the exterior surface of an outer shell 118 of an outer drum 112 of hose reel assembly 26 and passes through an opening 119 (FIG. 14) into an interior chamber 113 thereof. The portion of hose 28 on the exterior surface is secured in place by one or more clamps so that hose 28 does not slip off outer drum 112 as the drum rotates. Hose 28 defines a bore 28*a* therein and bore 28*a* is thus operationally connected, via diverter 110, fitting 102, first portion 76 of central shaft and fitting 98 to water line 62, which in turn is connected to water delivery system 58. Thus, when water delivery system 58 is activated via controller 42, water flows through line 62, through fitting 98, through connector 100, into bore 80 of first portion 76 of central shaft, through fitting 102, through passageway 104, into diverter 110, into bore 28*a* of hose 28, through nozzle 31 and, finally, into heat exchanger tubes 16.

Figure 11:
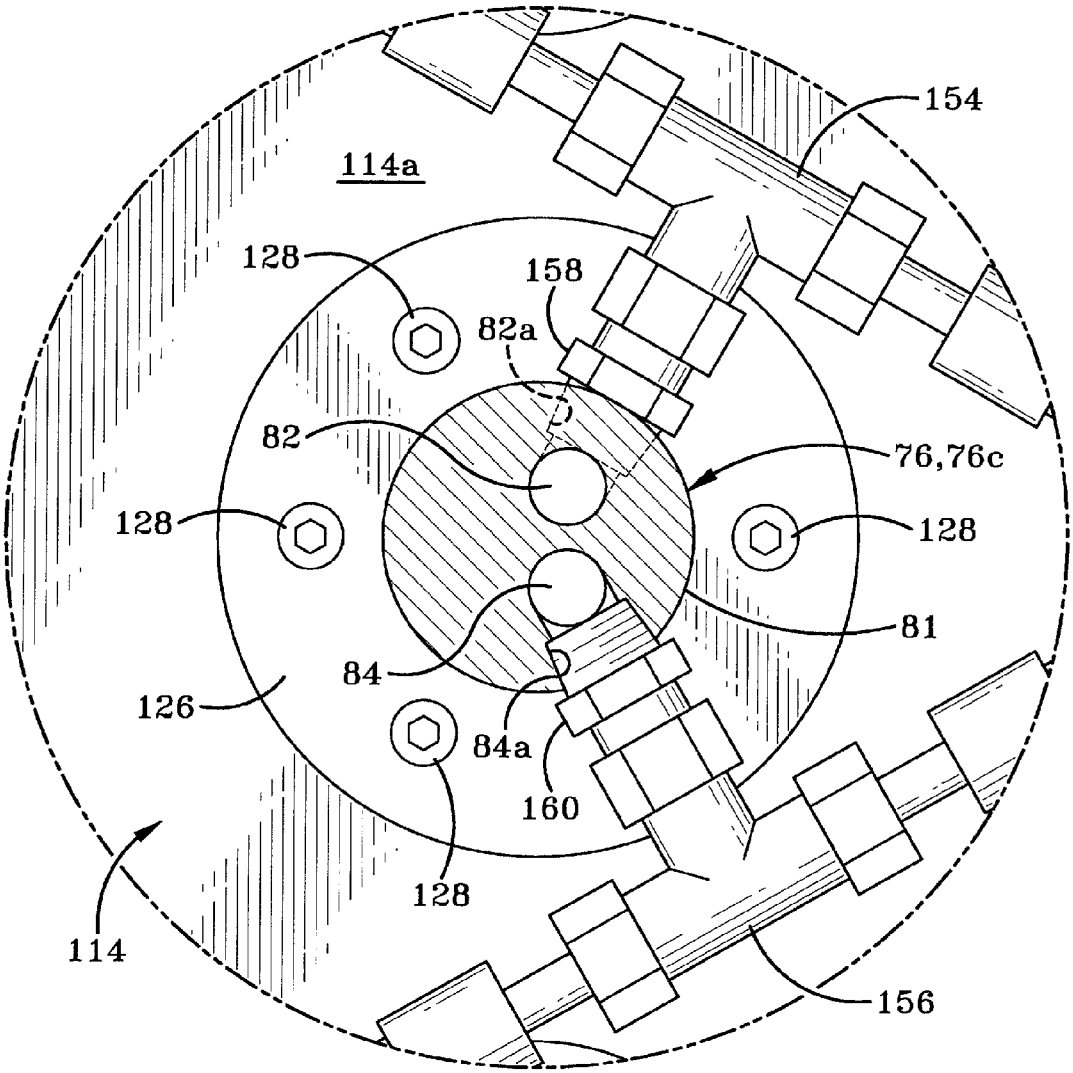
FIG. 11 is an enlarged front view of the highlighted region of FIG. 10 showing the connections between the hydraulic lines and the central shaft.
Figure 12:
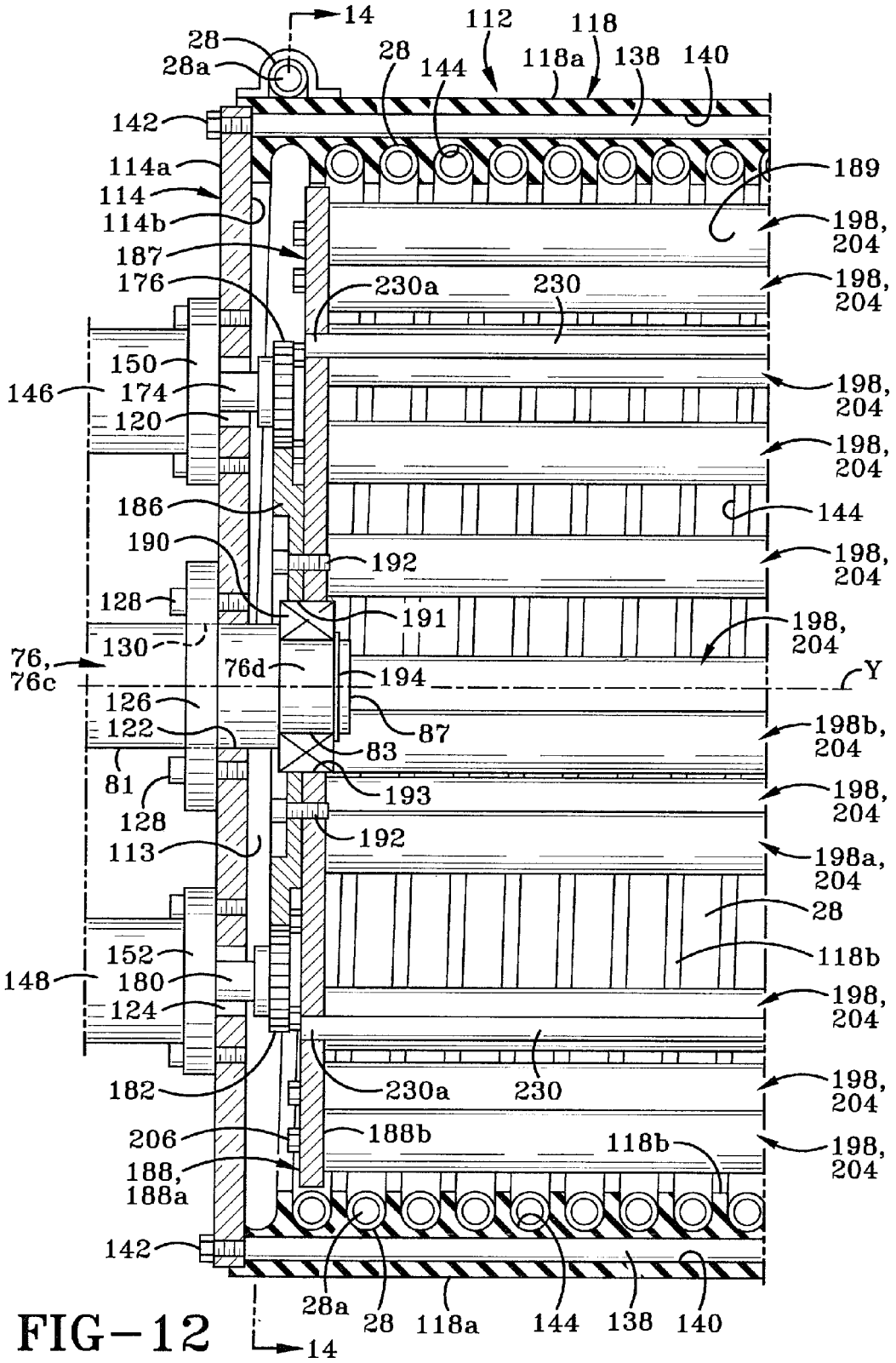
FIG. 12 is a cross-sectional side view of the front end of the hose reel assembly.

In accordance with yet another feature of the present invention, hose reel assembly 26 further comprises an outer drum 112 (FIG. 4) and an inner drum 187 (FIG. 12, 13, 14). Outer drum 112 includes a first drum plate 114, a second drum plate 116, and a generally cylindrical outer shell 118 disposed between first and second drum plates 114, 116. Both of first and second drum plates 114, 116 are planar members that are circular in shape and are vertically oriented so that they are disposed at right angles to longitudinal axis "Y". First and second drum plates 114, 116 and outer shell bound and define chamber 113 (FIG. 12) therein. As shown in FIG. 12, first drum plate 114 defines a first, second and third aperture 120, 122, 124 therein with each of these apertures extending between a front surface 114*a* and a back surface 114*b* of first drum plate 114. Second aperture 122 is centrally located on first drum plate 114 and first and third apertures 120, 124 are aligned with second aperture 120 but first aperture 122 is disposed a spaced distance on a first side of second aperture 120, and third aperture 124 is disposed a spaced distance on an opposite second side of second aperture 120. Second aperture 120 is of a sufficient size so as to permit third region 76*c* of first portion 76 of central shaft to pass therethrough. A mounting plate 126 having an aperture 130 (FIG. 11) therein is secured to front surface 114*a* of first drum plate 114 by a plurality of fasteners 128. Third region 76*c* of first portion 76 of central shaft passes through aligned apertures 130 in mounting plate 126 and second aperture 122 in first drum plate 114.

Figure 13:
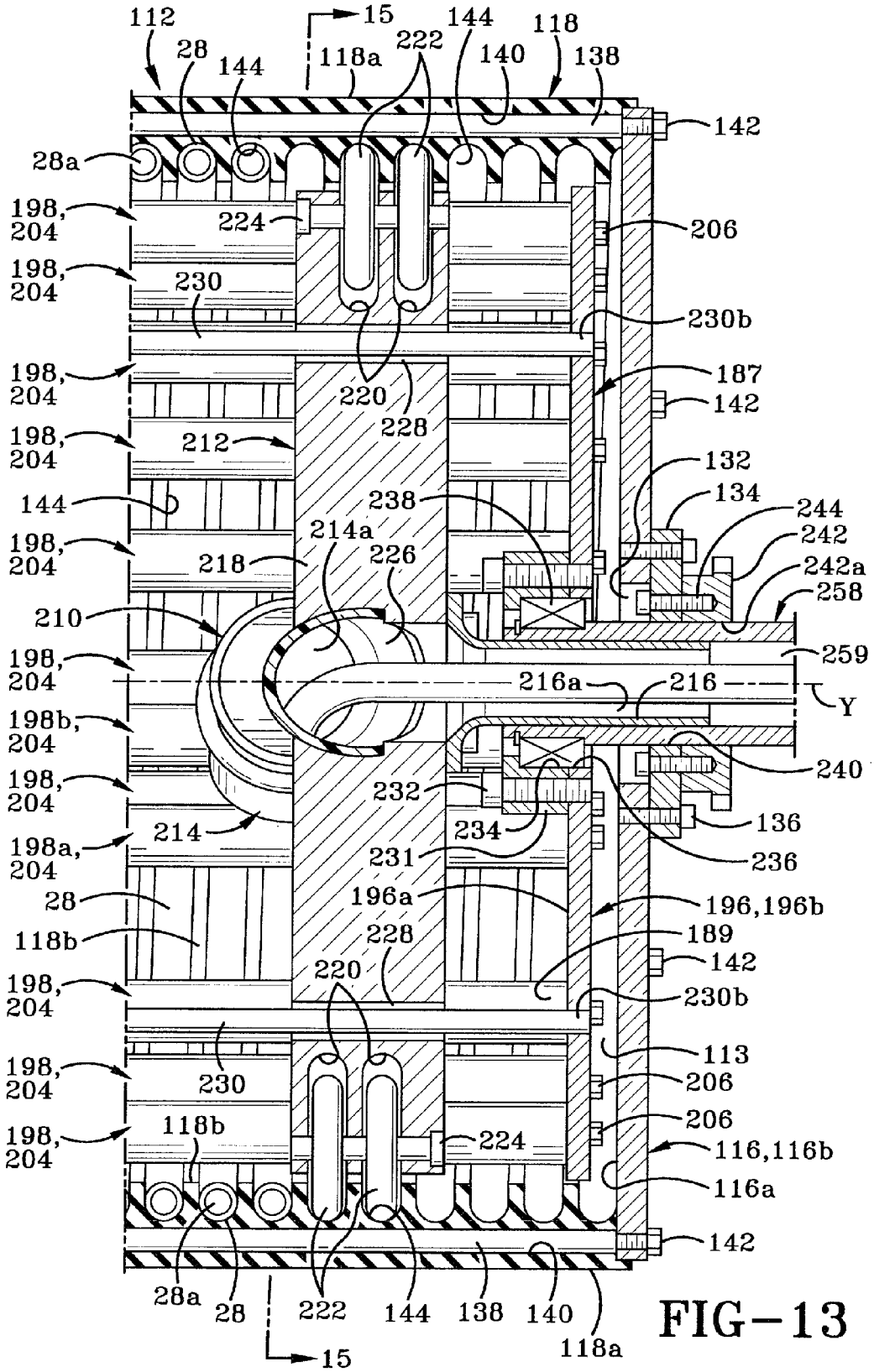
FIG. 13 is a cross-sectional side view of the rear end of the hose reel assembly.

Referring to FIG. 13, second drum plate 116 is a planar member that is circular in shape and is of an identical size to first drum plate 114. A first central aperture 132 is defined in second drum plate 116. A mounting plate 134 is secured to a rear face 116*b* of second drum plate 116 by a plurality of fasteners 136. A second portion 258 of the central shaft extends through first central aperture 132.

In accordance with yet another specific feature of the present invention, outer shell 118 of outer drum 112 extends between first and second drum plates 114, 116. Outer shell 118 may be comprised of a single cylindrical tube in which the helical groove 144 is cut. Alternatively, outer shell 118 may be comprised of two or more cylindrical tubes in which the helical groove 144 is cut, where the tubes are disposed in end-to-end relationship, rods 138 are passed through the two or more cylindrical tubes, and the tubes are then secured together by bolts, welds or any other fastening means. Still further, outer shell 118 may be formed from one or more cylindrical tubes having a helical groove 144 cut therein and where the one or more tubes are then cut lengthwise into two separate parts. The two separate parts are disposed longitudinally adjacent each other to form a tubular member and are secured together. Preferably, in this latter instance, the two separate parts are secured together in a manner that permits them to be separated from each other so that the operator is able to gain access into the interior of outer drum 118 for maintenance and access to other components located therein. Whatever the manner in which the tubular outer drum 118 is manufactured, first and second drum plates 114, 116 are secured to outer drum 118 by rods 138. Each rod 138 extends through a longitudinally aligned aperture 140 (FIG. 12) defined in one of the two sections of outer shell 118 and through aligned holes (not numbered) in first and second drum plates 114, 116. Suitable nuts 142 are engaged with each end of rod 138 to secure the section of outer shell 118 between the inner surfaces 114*b*, 116*a* of first and second drum plates 114, 116.

Figure 16:
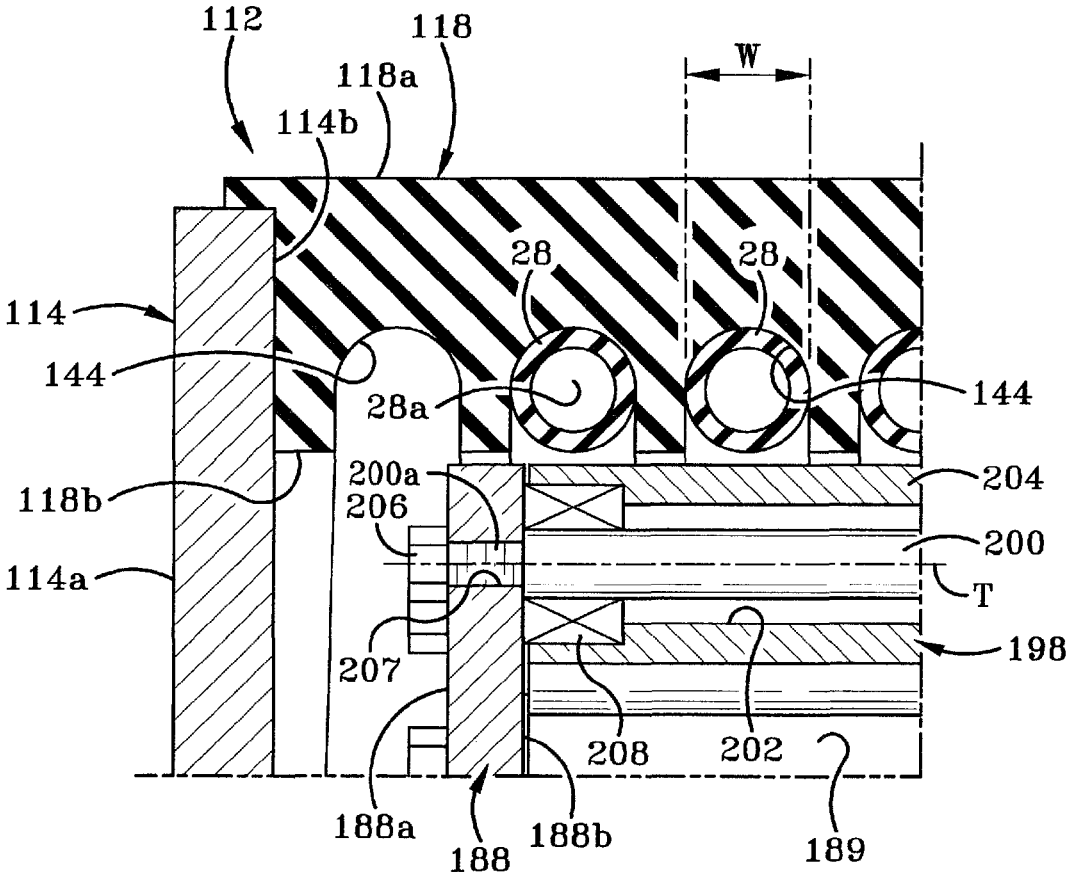
FIG. 16 is a cross-sectional side view of the outer drum, the inner drum and the tubular members of the inner drum taken through line 16-16 of FIG. 14.

As is evident from FIGS. 12, 13 and 16, outer shell 118 has an exterior surface 118*a* that is substantially smooth and curved, and has an interior surface 118*b* (numbered only in FIG. 16) that defines a groove 144 therein. Groove 144 is comprised of a number of U-shaped annular grooved sections that extend around substantially the entire inner circumference of outer shell 118. The grooved sections are disposed substantially parallel to each other and preferably are angled to a sufficient degree relative to each other so that they form one substantially continuous groove. It should be understood that grooved sections are substantially continuous with each other in much the same way as the grooves of an internally threaded fixture would be substantially continuous. It should further be noted that each grooved section has a width "W" (FIG. 16) that is slightly greater than the diameter of hose 28. Thus, interior surface 118*b* of outer drum 112 provides an internally grooved region wherein each section of groove 144 is configured to receive a section of hose 28 therein as will be hereinafter described.

Figure 10:
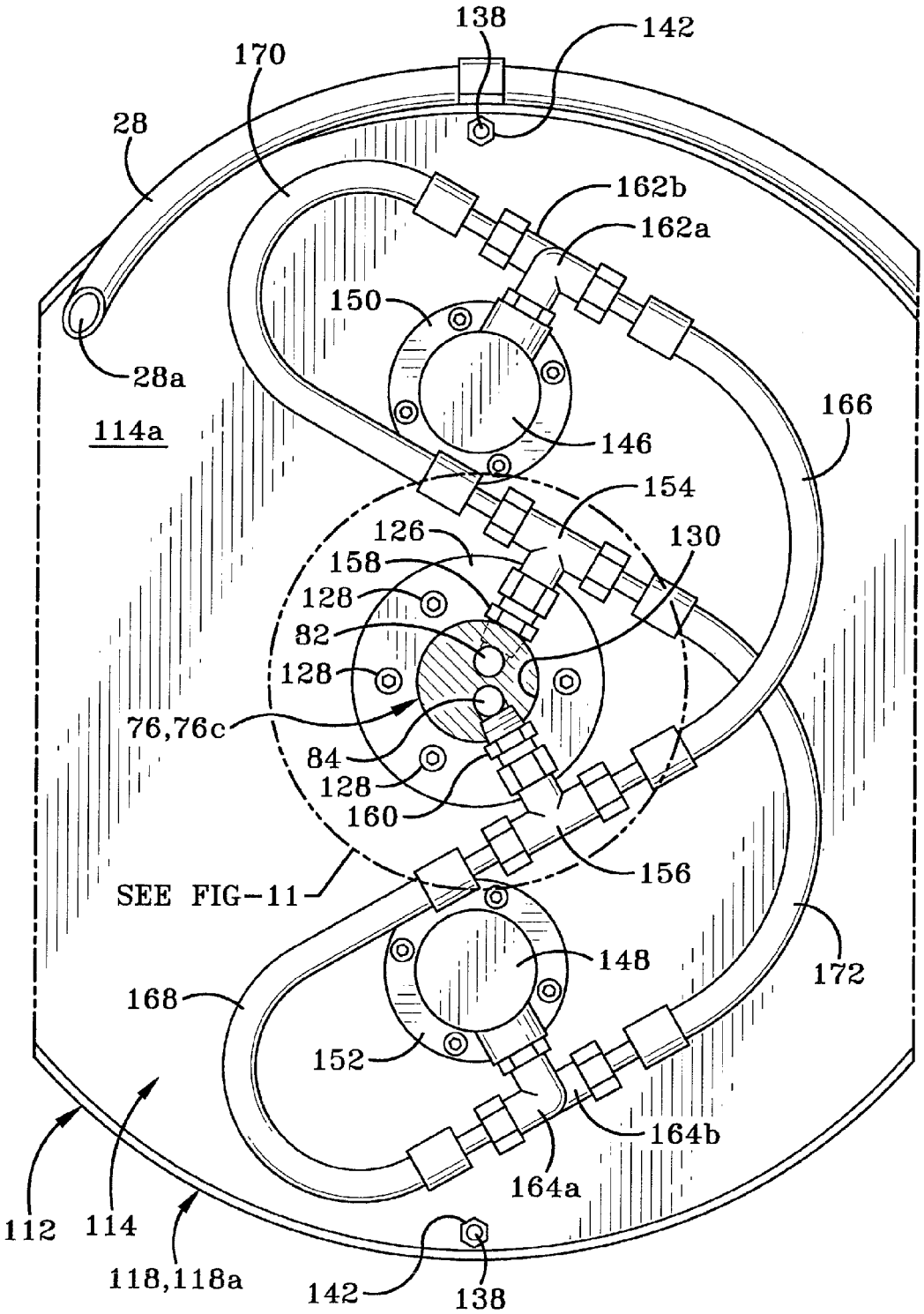
FIG. 10 is a front view of the first drum plate of the outer drum and the two hydraulic motors, taken through line 10-10 of FIG. 4.

In accordance with yet another feature of the present invention, and as best seen in FIGS. 10 and 12, first hydraulic motor 146 and second hydraulic motor 148 are mounted on a front face 114*a* of first drum plate 114. Specifically, a mounting plate 150 is secured to front face 114*a* of first drum plate 114 and a portion of first hydraulic motor 146 extends through an aperture (not shown) in mounting plate 150 and through first aperture 120 in first drum plate 114. Similarly, a mounting plate 152 is secured to front face 114*a* of first drum plate 114 and a portion of second hydraulic motor 148 extends through an aperture (not shown) in mounting plate 152 and through second aperture 124 in first drum plate 114. First and second hydraulic motors 146, 148 are fixedly engaged to first drum plate 114 so that when first drum plate 114 is rotated about first portion 76 of central shaft, then first and second hydraulic motors 146, 148 rotate in unison with first drum plate 114.

FIGS. 10 and 11 show that a first splitter 154 is operationally engaged with third region 76*c* of first portion 76 of central shaft at a first location and a second splitter 156 is operationally engaged with third region 76*c* of first portion 76 of central shaft at a second location. First splitter 154 has a connector 158 that is engaged in first passageway 82*a* on third region 76*c* and is thereby operationally engaged with second bore 82 of first portion 76 of central shaft. Second splitter 156 has a connector 160 that is engaged in second passageway 84*a* on third region 76*d* and is operationally engaged with third bore 84 of first portion 76 of central shaft. A first and a second connector 162*a*, 162*b* (FIG. 4) are provided on first hydraulic motor 146 and a first and a second connector 164*a*, 164*b* are provided on second hydraulic motor 148. A first hydraulic tube 166 extends from first connector 162*a* to a first end of second splitter 156. A second hydraulic tube 168 extends from the second end of second splitter 156 to first connector 164*a* on second hydraulic motor 148. A third hydraulic tube 170 extends from second connector 162*b* on first hydraulic motor 146 to a first end of first splitter 154 and a fourth hydraulic tube 172 extends from a second end of first splitter 154 to second connector 164*b* on second hydraulic motor 148. Thus, the first and second hydraulic motors 146, 148 are in fluid communication with each other and with bores 80, 82 of first portion 76 of central shaft.

Figure 14:
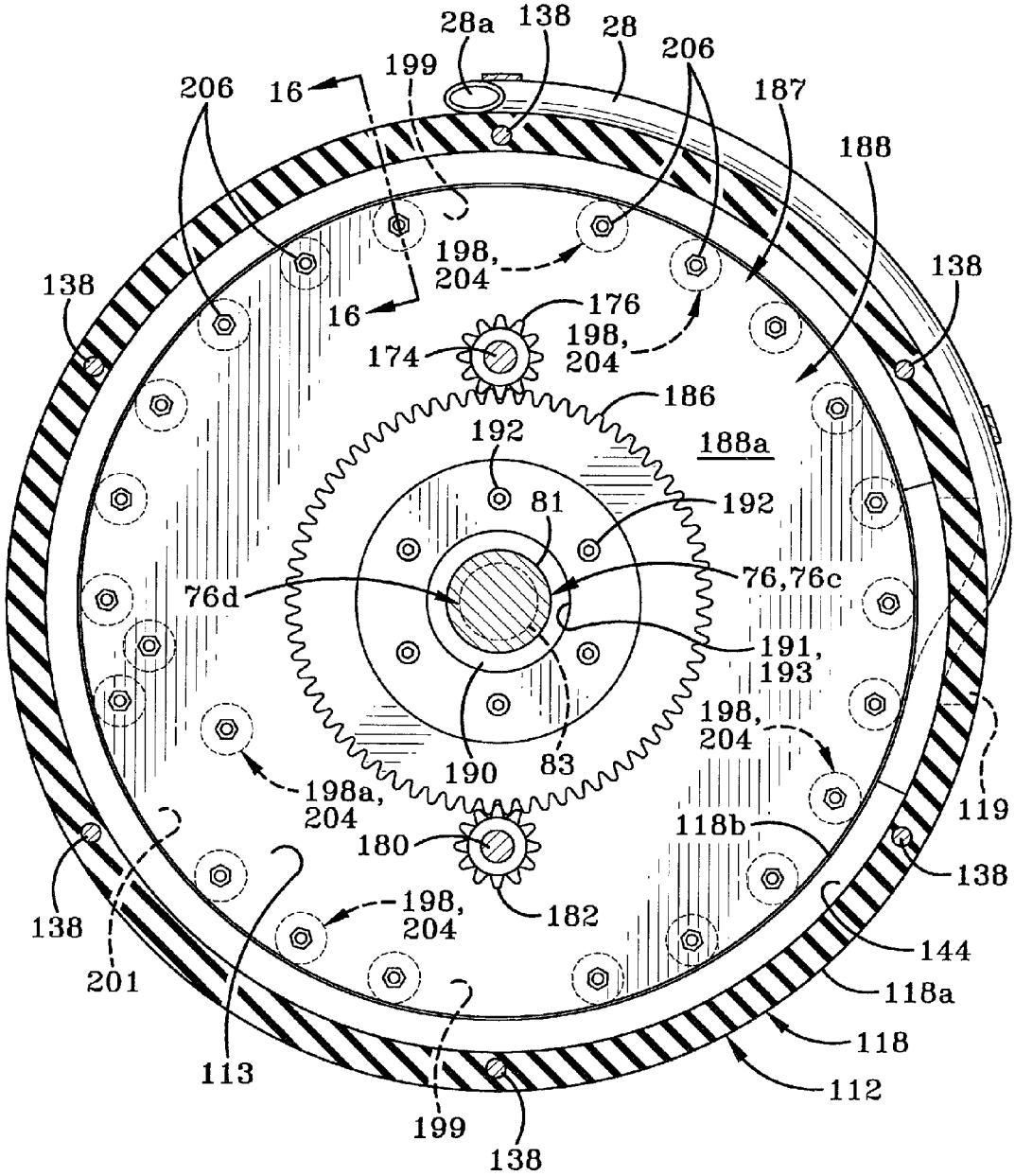
FIG. 14 is a cross-sectional front view of the outer drum and the first inner drum plate taken through line 14-14 of FIG. 12.

FIGS. 12 and 14 show that a first drive shaft 174 extends outwardly from a rear end of first hydraulic motor 146 and projects through first aperture 120 in first drum plate 114 to engage a first gear 176. Similarly, a second drive shaft 180 extends outwardly from a rear end of second hydraulic motor 148 and projects through third aperture 124 in first drum plate 114 to engage a second gear 182. First and second gears 176, 182 are satellite gears that have teeth which mesh with the teeth of a sun gear 186 that is substantially greater in size and is located centrally between them.

Figure 15:
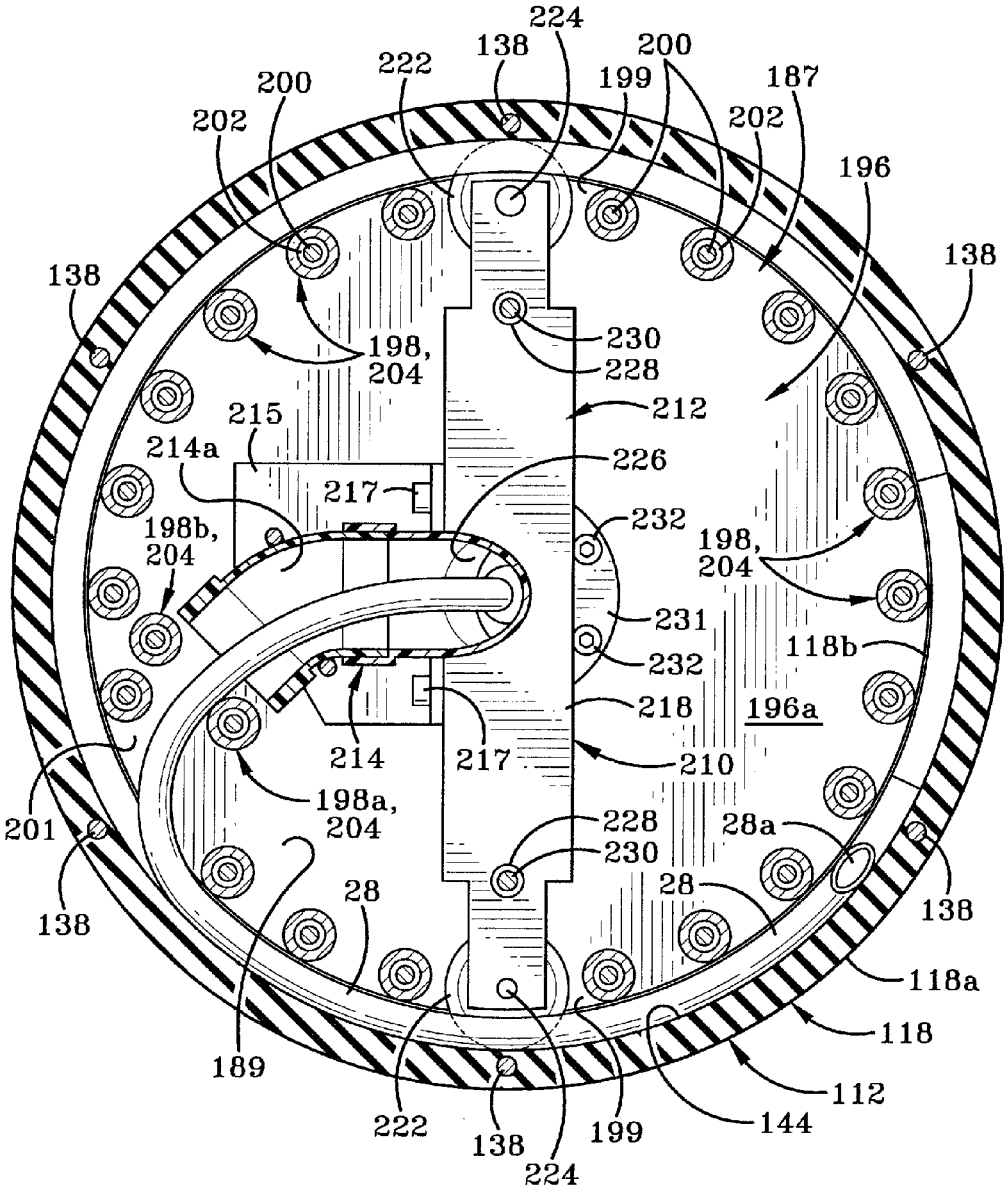
FIG. 15 is a cross-section front view of the outer drum, the inner drum and the follower taken through line 15-15 of FIG. 13.

Referring to FIGS. 12, 13 and 14, inner drum 187 is disposed within chamber 113 defined by first and second sections of outer shell 118. Inner drum 187 includes a first inner drum plate 188 and a second inner drum plate 196 that are connected to each other by a plurality of longitudinally extending tubular members 198. First inner drum plate 188 is disposed inwardly of first drum plate 114 and second inner drum plate 196 is disposed inwardly of second drum plate 116. First inner drum plate 188 has a front surface 188*a* and a rear surface 188*b* and second inner drum plate 196 has a front surface 196*a* and a rear surface 196*b*. Each tubular member 198 is comprised of a rod 200 disposed within a bore 202 of a pipe 204. Each end of rod, such as end 200*a* (FIG. 16) is threaded and extends through an aperture 207 in one of first and second inner drum plates 188, 196. A fastener 206 secures each end 200*a* of rod 200 to one of first and second inner drum plates 188, 196. Furthermore, a bearing 208 is provided at each end 200*a* of rod 200 so that pipe 204 is able to freely rotate about rod 200. Pipe 204 is therefore able to freely rotate about a longitudinal axis "T" (FIG. 16) which is disposed substantially parallel to longitudinal axis "Y" of hose reel assembly 26. First and second inner drum plates 188, 196 and tubular members 198 bound and define a chamber 189 therein (FIG. 15).

As shown in FIG. 12, first, second and third gears 176, 182, 186 are disposed adjacent front surface 188*a* of first inner drum plate 188. Fourth region 76*d* of first portion 76 of central shaft extends through an aperture in a bearing 190 which in turn is received through aligned apertures 191, 193 in sun gear 186 and first inner drum plate 188. Sun gear 186 is fixedly engaged with first inner drum plate 188 by way of a plurality of fasteners 192. A lock washer 194 is engaged in groove 86 in fourth region 76*d* of first portion 76 of central shaft and adjacent second end 87 thereof so as to prevent fourth region 76*d* from being withdrawn from its engagement with bearing 190. Thus, when either of first and second hydraulic motors 146, 148 is activated, first, second and third gears 176, 182, 186 are cause to rotate in one of a first and a second direction and, consequently, inner drum 187 is caused to rotate in one of a clockwise and counter-clockwise direction.

FIGS. 13 and 7-20 show a feed mechanism 210 which is disposed within chamber 189 of inner drum 187. It will be understood that any suitable feed mechanism may be used in the present invention to change the direction of hose 28 from being axially wound into or out of the groove 144 in outer drum 112 to extending linearly/longitudinally out of hose reel assembly 26, without departing from the scope of the present invention.

In the preferred embodiment of the invention illustrated herein, feed mechanism 210 is configured to engage in groove 144 of outer drum 112 and is useful for feeding hose 28 into grooves 144 of outer drum 112 and removing hose 28 therefrom. Feed mechanism 210 comprises a follower 212, an elbow 214 and a stabilizer 216 which preferably are manufactured from a polymer or nylon. Alternatively, feed mechanism may be a machined or molded component where the follower 212, elbow 214 and stabilizer 216 are manufactured as a single, unitary component. Still further, a plurality of rollers may be utilized as the feed mechanism for feeding hose 28 into and out of the hose reel assembly.

In accordance with the present invention, follower 212 includes a base member 218 (FIG. 13) that is generally rectangular in shape and has a pair of U-shaped slots 220 defined in each of a first and a second end. Slots 220 are disposed generally aligned with a longitudinal axis of base member 218 and are substantially parallel to each other. A rotatable wheel 222 is positioned within each slot 220. Wheels 222 are mounted on an axle 224 extending through an aperture (not numbered) in base member 218. Axles 224 are oriented generally at right angles to the longitudinal axis of base member 218. Tubular members 198 are provided at substantially regular intervals adjacent the circumferential edge of both of first and second inner drum plates 188, 196 except for in two locations. Each pair of adjacent tubular members 198 is separated from each other by a space except for the two above-referenced two locations where the space between the pair of adjacent tubular members 198 is greater in size along the circumference of first and second inner drum plate 188, 196 than the space between any other pair of adjacent tubular members 198. These two locations are best seen in FIG. 15 and are disposed at 180° relative to each other. At each wider location at least one tubular member is omitted so that a gap 199 is formed. The ends of follower 212 and wheels 222 are positioned within these gaps 199. A portion of each wheel 222 projects outwardly beyond the circumferential edges of first and second inner drum plates 188, 196 and is complementary sized and shaped to be received in one of the grooved sections of groove 144 of outer shell 118. Thus, wheels 222 link inner drum 187 to outer drum 112.

As best seen in FIG. 13, elbow 214 is mounted on a mounting plate 215 (FIG. 15) which is secured to base member 218 by a plurality of fasteners 217. Base member 218 defines a channel 226 therein and with which both elbow 214 and stabilizer 216 are in communication. As shown in FIGS. 15 and 13, hose 28 is threaded through the bore 214*a* of elbow, through channel 226 and through bore 216*a* of stabilizer. FIG. 15 also shows two additional tubular members, 198*a*, 198*b* that are disposed adjacent the mouth of elbow 214 and on either side of the portion of flexible hose 28 exiting the mouth of elbow 214. Tubular members 198*a*, 198*b* aid in feeding hose 28 into and out of elbow 214 in that they act as guides for hose 28 and are able to rotate independently, thus helping the inward or outward movement of hose 28 into and out of elbow 214

Base member 218 of follower 212 includes two longitudinally aligned slots 228. A rod 230 extends through each slot 228 and a first end 230*a* (FIG. 12) of rod 230 is secured to first inner drum plate 188 and a second end 230*b* (FIG. 13) of rod 230 is secured to second inner drum plate 196. Because rods 230 secure follower 212 to inner drum 187, when inner drum 187 rotates, follower 212 rotates in unison therewith. As inner drum 187 is rotated in one of a clockwise and counterclockwise direction, feed mechanism 210 moves in a first direction toward first inner drum plate 188. When inner drum 187 is rotated in the other of a clockwise and counterclockwise direction, feed mechanism 210 moves in a second direction toward second inner drum plate 196. The movement of feed mechanism 210 feeds hose 28 into hose reel assembly 26 or out of hose reel assembly 26, as will be described hereafter. Elbow 214, stabilizer 216 and tubular members 198*a*, 198*b* ensure that hose 28 is fed smoothly into and out of hose reel assembly 26.

FIG. 13 shows a lock ring 231 mounted to an interior surface of second inner drum plate 196 by way of fasteners 232. Lock ring 231 defines an aperture 234 therein which aligns with an aperture 236 in second inner drum plate 196. A bushing 238 is provided in lock ring 231 and is disposed in engagement with second portion 258 of central shaft and bushing 238 allows for relative movement therebetween. Stabilizer 216 with hose 28 disposed therethrough is able to be at least partially received through bore 259 of second portion 258 of central shaft at certain times.

Figure 17:
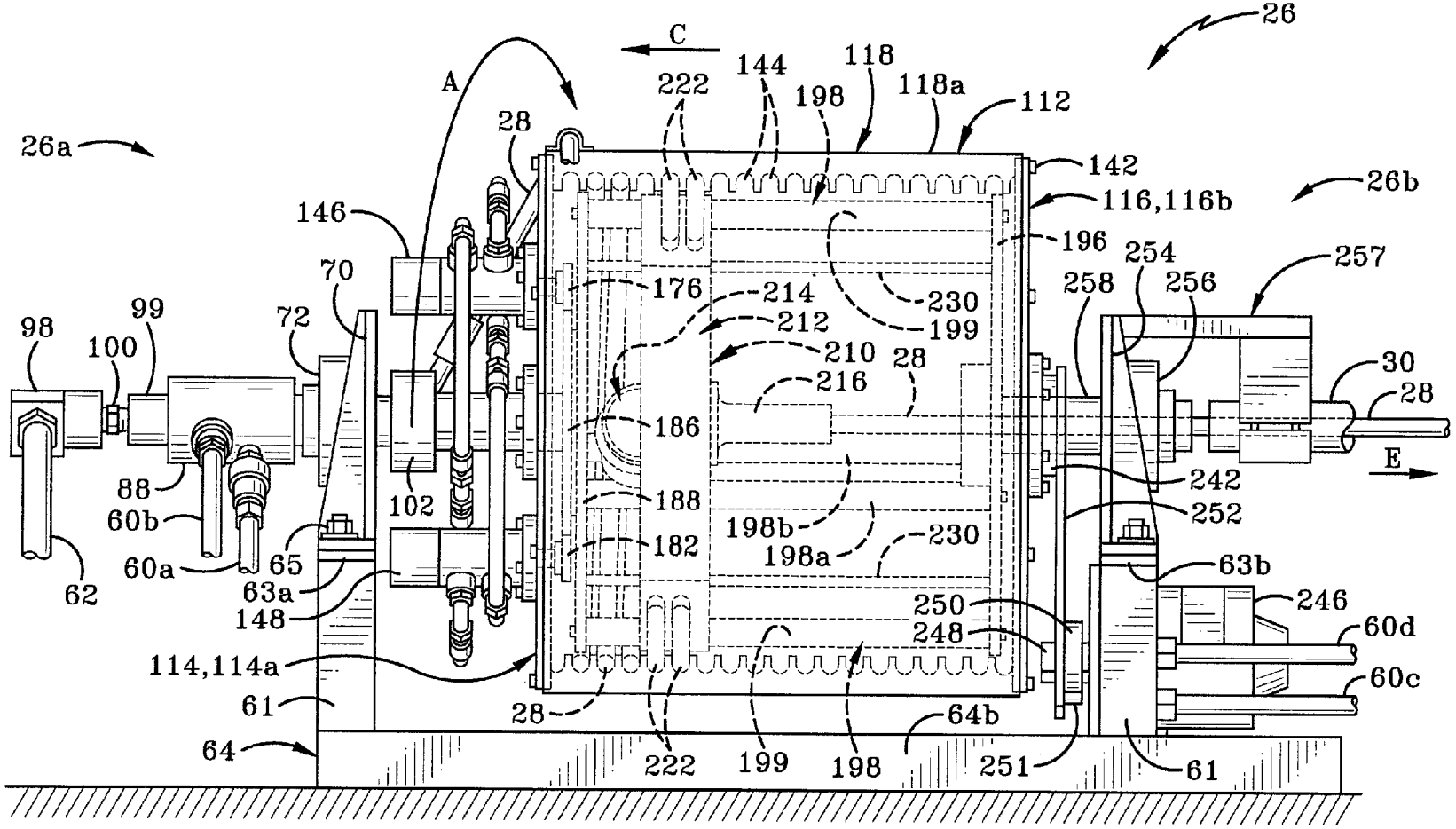
FIG. 17 is a side view of the hose reel assembly showing the flexible hose being drawn out of the apparatus and being wound off the inner drum.

Second portion 258 of central shaft extends through the aligned aperture 132 in second drum plate 116, aperture 240 in mounting plate 134 and through an aperture 242*a* in an upper gear sprocket 242. Upper gear sprocket 242 is secured to mounting plate 134 by fasteners 244. Part of stabilizer 216 also extends through this part of second portion 258 of central shaft at certain times. FIG. 17 shows that a motor 246 is mounted onto base 64 and a drive shaft 248 extends outwardly therefrom to engage a lower gear sprocket 250 and a lower tensioner sprocket 251. A drive belt 252 extends between upper and lower sprockets 242, 250, 251 so that motion imparted to drive shaft 248 by motor 246 will be transferred to lower sprockets 250, 251 and then via drive belt 252 to upper gear sprocket 250. Since upper gear sprocket 250 is fixedly engaged with mounting plate 134, motion in upper gear sprocket 250 will be imparted to mounting plate 134 and thereby to second drum plate 116. Thus, when motor 246 is activated, outer drum 112 is caused to rotate. It should also be noted that hydraulic lines 60*c*, 60*d* extend between hydraulic oil delivery system 54 and motor 246.

Referring still to FIG. 17, a second bearing plate 254 is mounted to legs 61 of base 64 adjacent motor 246 and a bearing 256 is secured to second bearing plate 254 by way of fasteners 74. A clamping member 257 extends outwardly from second bearing plate 254 to clampingly engage an end region of protective tubing 30. Hose 28 extends outwardly through bore 216*a* of stabilizer 216, through bore 259 of second portion 258 of central shaft and into the end region of protective tubing.

Referring to FIGS. 1 & 17-20, hose reel assembly 26 is used in the following manner. Hose reel assembly 26 is activated to perform a number of different operations. Hose 28 may be fed out of hose reel assembly 26 or may be reeled into hose reel assembly 26. Furthermore, hose reel assembly 26 can be activated to cause hose 28 to rotate rapidly about the hose's longitudinal axis, i.e. at right angles to the hose's circular cross-section. This rotation of hose 28 is of importance in that it imparts that rotational motion to nozzle 31. If nozzle 31 does not rotate about the hose's longitudinal axis, then any water jet 23 being expelled from nozzle 31 would simply cut a single, clean hole through any deposits 21 accumulated within bore 20 of a selected tube 16. However, if hose 28 and therefore nozzle 31, is rotated about the hose's longitudinal axis, then water jet 23 is itself rotated through 360°, thus cutting a circular arc through deposits 21 in bore 20 of tube 16. As the rotating hose 28 is moved downwardly deeper into bore 20 of tube 16, substantially all of the deposits 21 will be cut from the interior surface of wall 18 and will be flushed from tube 16.

In order to begin cleaning heat exchanger tubes 16, second end 30*b* of tubing 30 is engaged with the platform 34 of indexer 32 and indexer 32 is introduced through opening 22 in housing 14 of heat exchanger 12. Indexer 32 is placed in a first location within space 24 so that it is positioned adjacent upper ends of tubes 16 in a first region of heat exchanger 12. A sufficient length of hose 28 is unwound from hose reel assembly 26, as will be hereinafter described, so that nozzle 31 will extend outwardly and downwardly from second end 30*b* of tubing 30. Nozzle 31 is positioned so that it extends downwardly from the lower surface of platform 34 and so that it is positionable directly vertically over an opening to the bore 20 of any selected one of the tubes 16. Indexer platform 34 is controlled by way of joystick 48 on controller console 42 and is movable both backward-and-forward and from side-to-side so that nozzle 31 can be positioned over the opening to any one of the tubes 16 in the first region of heat exchanger 12. It will be understood that instead of utilizing a human operator controlling a joystick to manipulate the movement of the indexer, controlling the operation of the hose reel, and the nozzle, the control unit could be programmed to automatically move the indexer over particular regions of tubes, control the movements of the hose reel and nozzle, and be utilized to monitor and clean the tubes. Any manner of programming the control unit, the indexer, the hose reel and/or the nozzle is contemplated to fall within the scope of the present invention. It should further be understood that additional components such as sensors, measuring and monitoring devices of any nature that will aid in the cleaning operation and may or may not be linked to the control unit, may also be incorporated into the device of the present invention.

It should be noted that second end 30*b* of protective tubing 30 secured to platform 34 is disposed a distance above nozzle 31 so that second end 30*b* in no way will impede the flow of water 23 out of nozzle 31. Tubing 30 extends from indexer 32 to clamping member 257 and ensures that the operator and other workers will not accidentally come into contact with the rapidly rotating hose 28 during cleaning operations and thereby be accidentally injured.

Once indexer 32 is located over a first selected tube 16 to be cleaned, the operator will view the feed from camera 36 and will activate hose reel assembly 26 by engaging control buttons 46. The operator may need to feed a length of hose 28 out of hose reel assembly 26 to reach deposits 21 in bore 20 or may need to draw in a length of hose 28 into hose reel assembly 26 to position nozzle correctly. Additionally, the operator will need to deliver pressurized water through hose 28 and into bore 20 of the selected tube 16 and increase the length of hose 28 so that nozzle 31 moves downwardly through bore 20 as deposits 21 are removed. Each of these actions involves activation of one or more components on hose reel assembly 26 by way of control buttons 46 and/or joystick.

Figure 18:
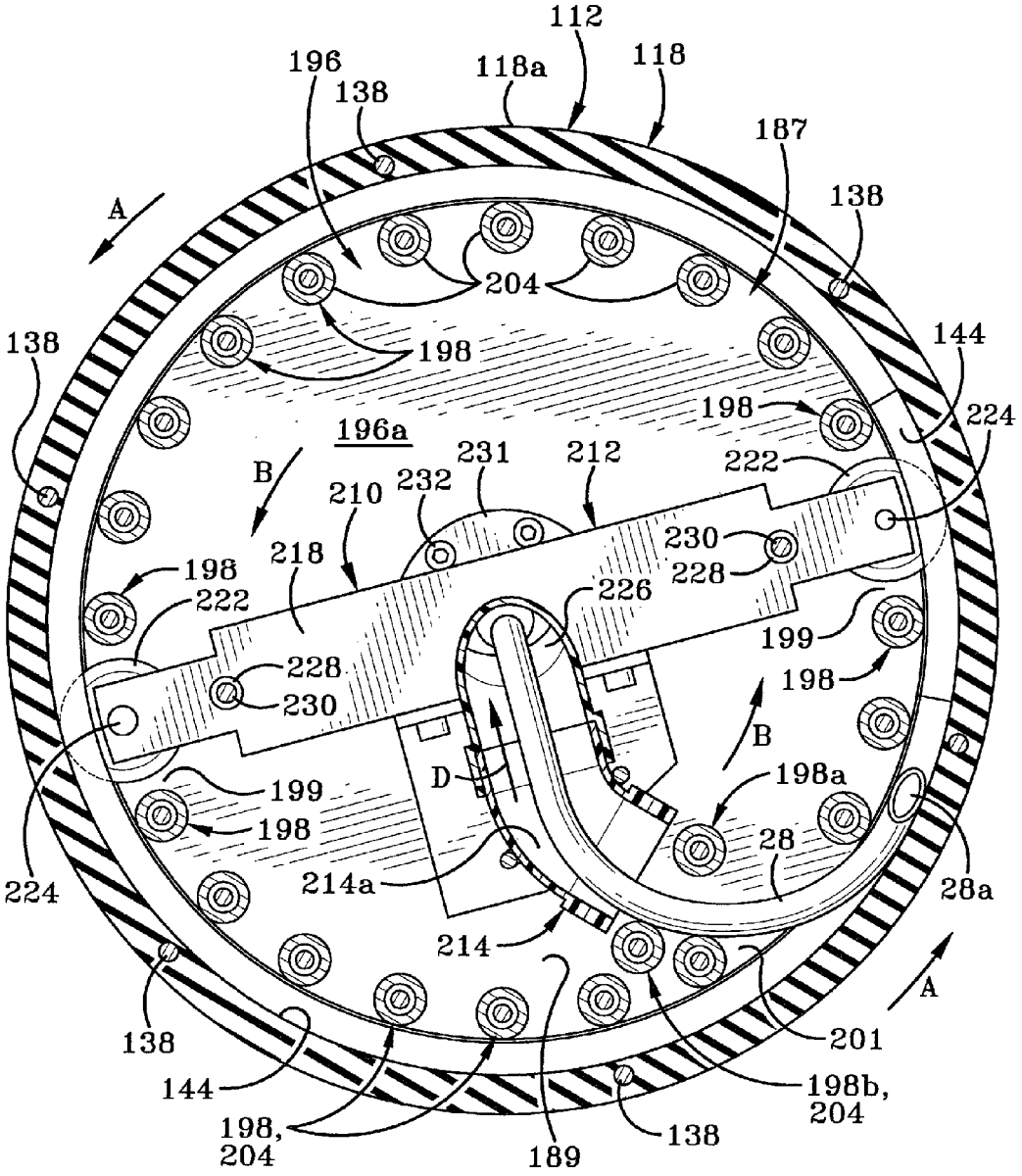
FIG. 18 is a cross-sectional front view of the outer drum, the inner drum and the follower showing the direction of rotation of the various components when the hose is wound off of the inner drum.
Figure 19:
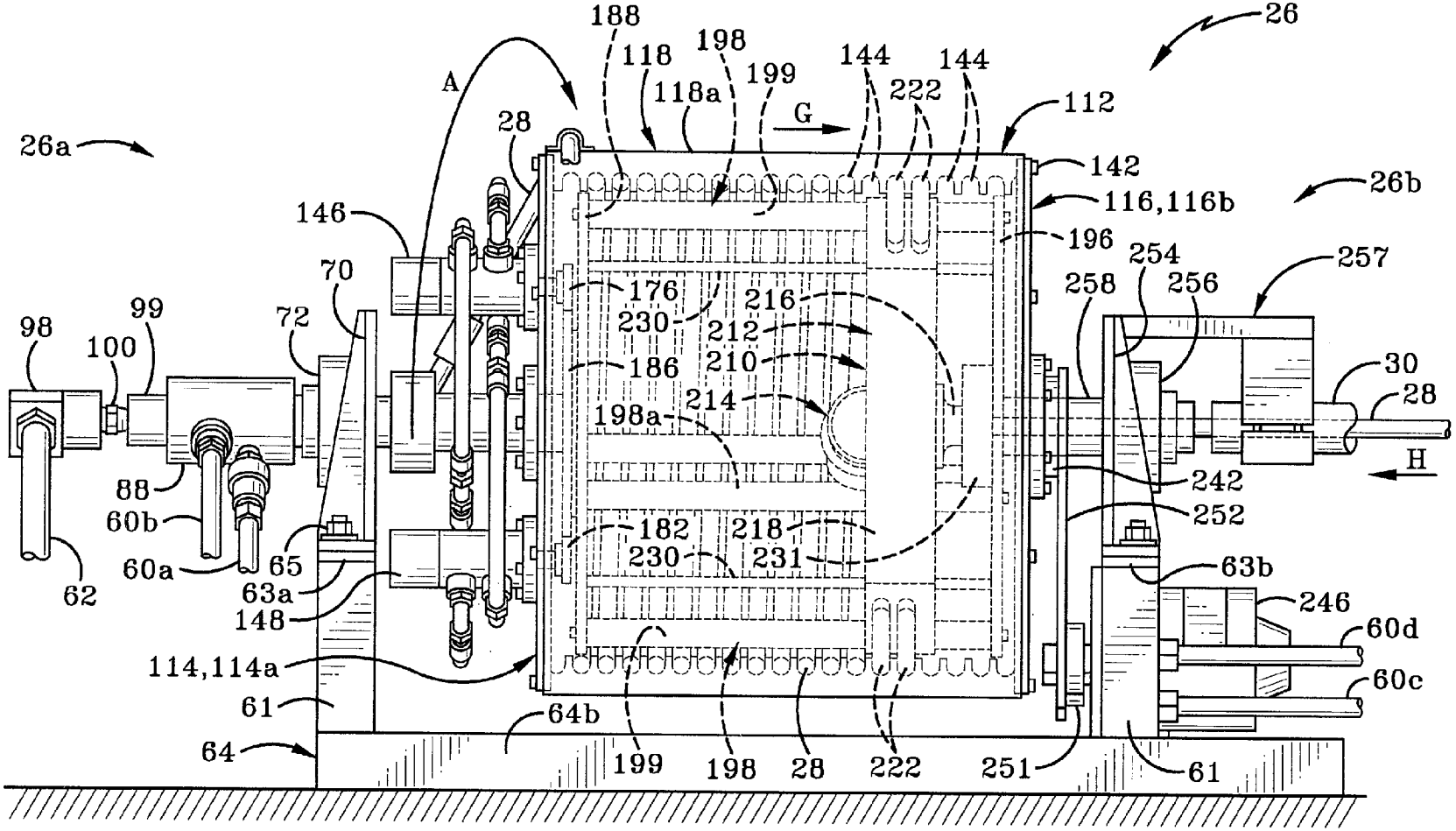
FIG. 19 is a side view of the hose reel assembly showing the flexible hose being drawn inwardly into the apparatus and being wound onto the inner drum.
Figure 20:
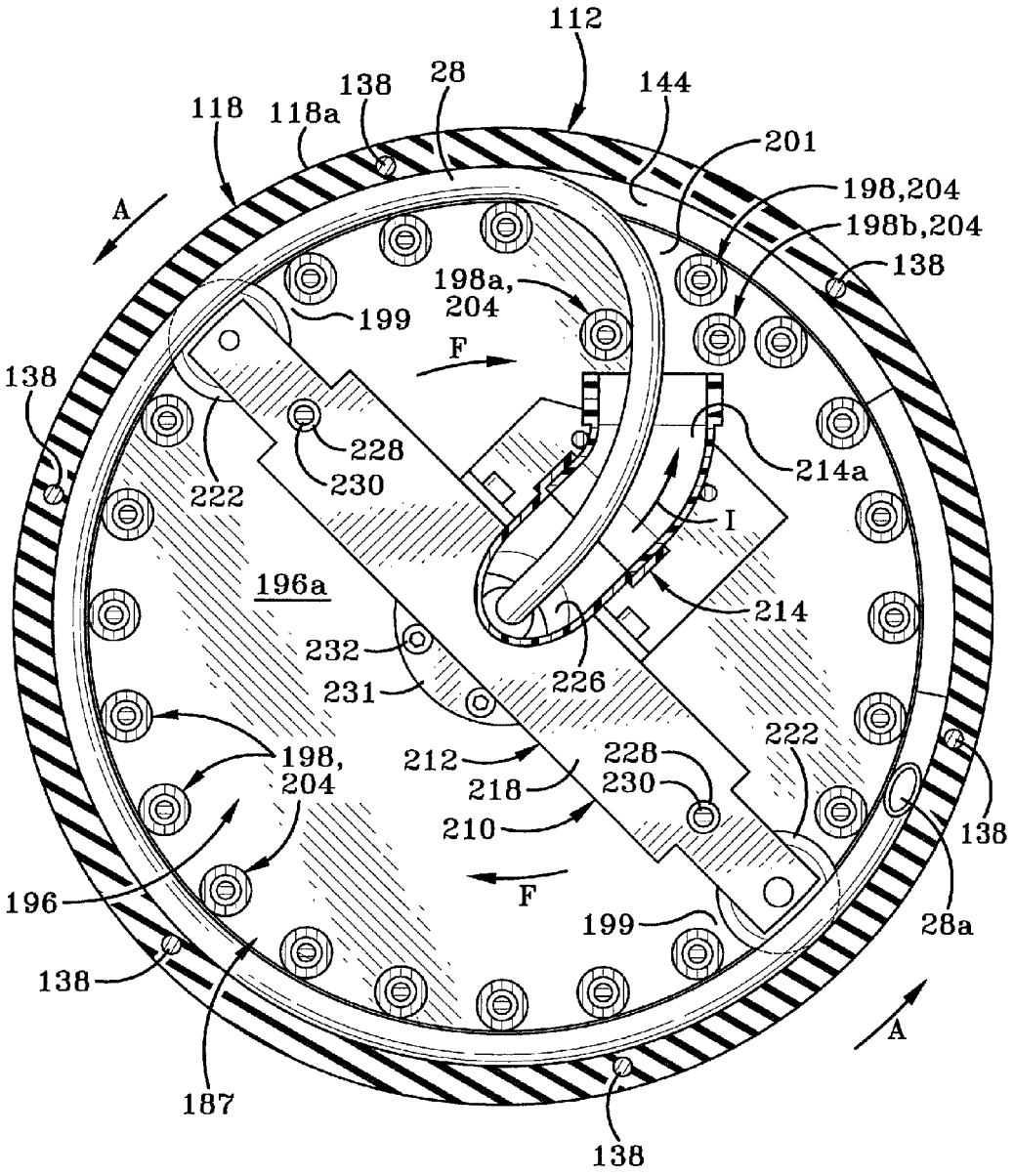
FIG. 20 is a cross-sectional front view of the outer drum, the inner drum and the follower showing the direction of rotation of these members when the hose is wound onto the inner drum.

It will be understood that initially, most of the length of hose 28 is wound onto inner drum 187 and is retained within groove 144 of outer drum 112, i.e., hose reel assembly 26 is generally in the position shown in FIG. 19. There may be a length of hose 28 that permanently extends outwardly from hose reel assembly 26 and is not wound onto inner drum 187. This length of hose 28 would be available for insertion through bore 30*a* of tubing 30. It will be understood that hose reel assembly 26 may be provided in a variety of sizes to accommodate different length hoses 28 in order to clean different heat exchangers under different conditions. Suffice to say that a large percentage of hose 28 will be wound about the circumference of inner drum 187 defined by tubular members 198 when hose reel assembly 26 is connected to indexer 32. Hose 28 is retained in groove 144 of outer shell 118 of outer drum 112. Initially, feed mechanism 210 is generally in the position shown in FIGS. 13 and 19, i.e., follower 212 is positioned proximate second inner drum plate 196 and a relatively shorter length of hose 28 extends through elbow 214, through channel 226 in follower 218, through stabilizer 216, through a second portion of second portion 258 of central shaft, through bearing 256 and through bore 30*a* of tubing 30. As cleaning of heat exchanger 12 proceeds, it becomes necessary to feed additional lengths of hose 28 out of hose reel assembly 26. In order to feed hose 28 out of hose reel assembly 26, inner drum 187 is rotated in the direction of arrow "B" (FIG. 18) to unwind the desired length of hose 28 out of groove 144. The rotation of inner drum 187 is accomplished by the operator activating first and second hydraulic motors 146, 148 via controller console 42 so as to move hydraulic fluid in a first direction through hydraulic lines 60*a* 60*b*, through bores 84, 82 of first portion 76 of central shaft, through splitters 154, 156, 162*a*, 162*b*, 164*a*, 164*b* and through tubes 166, 168, 170, 172 attached to first and second hydraulic motors 146, 148. Activated motors 146, 148 cause gears 176, 182 to rotate. Gears 176, 182 engage sun gear 186 which is fixedly secured to first inner drum plate 188 and therefore causes inner drum plate 187 to rotate in the direction "B" (FIG. 18). The rotation of inner drum 187 causes follower 212 to rotate about longitudinal axis "Y" and to simultaneously move within chamber 189 in the direction indicated by arrow "C" (FIG. 17) and toward first inner drum plate 188. The motion of follower 212 causes hose 28 to be progressively unwound from groove 144 and to be fed in the direction of arrow "D" (FIG. 18) through elbow 214, and through stabilizer 216 (FIG. 13). A length of hose 28 moves through bore 30*a* of tubing 30 in the direction of arrow "E" (FIG. 17). Ultimately, follower 212 will be positioned closer to first inner drum plate 188 than it was initially.

Once nozzle 31 is in the correct position, the operator will activate the water delivery system 54 to deliver pressurized water to hose 28. The water is at a pressure of about 10,000 psi to about 60,000 psi. The flow of the water through hose reel assembly 26 has been previously described herein.

In order to thoroughly clean bore 20 of tube 16, it is also necessary to rotate hose 28 about its longitudinal axis, i.e. about an axis disposed at right angles to the hose's circular cross-section. This rotational motion aids in ensuring that water jet 23 will moves through 360°. The rotational motion of hose 28 is generated by rotation of outer drum 112. In order to rotate outer drum 112 in the direction indicated by arrow "A" (FIG. 17), motor 246 is activated via controller 42. Activation of motor 246 is accomplished by hydraulic oil moving from hydraulic oil delivery system 54 through tubes 60*c*, 60*d*. Motor 246 drives drive belt 252 via lower sprockets 250, 251 and drive belt 252, in turn, drives upper gear sprocket 242. Upper gear sprocket 242 is fixedly engaged to mounting plate 134 which in turn is fixedly secured to second drum plate 116. Consequently, the rotation of upper gear sprocket 242 is imparted to mounting plate 134 which, in turn, causes outer drum 112 to rotate. Rotation of outer drum 112 about longitudinal axis "Y" causes the hose 28 extending through elbow 214 and stabilizer 216 and outwardly through bore 30*a* of tubing 30 to be rotated about the hose's longitudinal axis. Effectively, the hose's longitudinal axis is aligned with longitudinal axis "Y" at the point hose 28 exits hose reel assembly 26. The rate of rotation of outer drum 112 is directly proportional to the rate of rotation of hose 28. Outer drum 112 is caused to rotate at a speed of about 100 rpm to about 1600 rpm, and preferably about 1000 rpm to about 1500 rpm. The speed of rotation of outer drum 112 is selected depending on the material being removed. Water is delivered through rotating hose 28 under a pressure of about 10,000 psi to about 60,000 psi. The high pressure, water jet 23 is thus delivered out of nozzle 31 (FIG. 1), with the nozzle 31 rotating the direction of arrow "J". The rotating water jet 23 blasts away the deposits 21 accumulated on wall 18 which defines bore 20 of tube 16. Water and the entrained removed deposits ultimately are flushed out of the top or bottom of the tube 16 by water jet 23, depending on the location of nozzle 31 within bore 20 and the extent of the blockage of bore 20. Depending on the type of deposits being removed from within heat exchanger tubes 16 very good removal rates have been achieved with the device of the present invention operating at speeds of from about 300 rpm up to about 1000 rpm. Again, very good removal rates of deposits within tubes 16 have also been achieved where the water pressure is at about 20,000 psi and at about 40,000 psi.

It should be understood that while outer drum 112 has been illustrated as being rotatable independently of the inner drum 187 in a first direction represented by arrow "A", outer drum 112 could alternatively be rotated in a second direction opposite to that represented by arrow "A", without departing from the scope of the present invention.

The rotation of outer drum 112 is maintained essentially through the entire cleaning operation as it is more economical to maintain the rotational speed of the hose 28 instead of stopping and starting that rotation each time an adjustment is made to the length of hose 28 or to the position of nozzle 31 relative to various tubes in the exchanger 12. Inner drum 187 is rotated only when it is necessary to feed hose 28 out of hose reel assembly 26 or to draw it into the same. When the operator is not actively feeding hose into or out of hose reel assembly 26, first and second hydraulic motors 146, 148 will be deactivated. The operator will therefore monitor the situation in heat exchanger 12 and will activate and deactivate the first and second hydraulic motors 146, 148 as needed.

When it is desired to withdraw a length of hose 28 from tube 16, for example when the first tube 16 has been cleaned, the direction of flow of hydraulic oil through hydraulic lines 60*a*, 60*b*, and therefore through first and second hydraulic motors 146, 148 is reversed. This reversal in flow direction causes inner drum 187 to rotate in the direction of arrow "F" (FIG. 20), i.e., in the opposite direction to the rotation "B". As is evident from FIG. 20, outer drum 112 remains rotating in the direction of arrow "A" during the operation so as to shorten the length of hose 28 extending out of hose reel assembly 26. At the beginning of this operation, follower 212 could be positioned generally in the location illustrated in FIG. 17 i.e., closer to first inner drum plate 188 than to second inner drum plate 196. The rotation of inner drum 187 in the direction of arrow "F" causes follower 212 to rotate about longitudinal axis "Y" in an opposite direction to its previous rotation and to move in the direction of arrow "G" (FIG. 19) through chamber 189 and toward second inner drum plate 196. The motion of follower 212 in turn causes a length of hose 28 to be drawn through tubing 30 in the direction of arrow "H". Hose 28 is moved through elbow 214 in the direction of arrow "I" and is laid down into groove 144 of outer drum 112 by the rotating follower 212. Ultimately, follower 212 will be disposed closer to second inner drum plate 196 than it was when in its initial position. The operator will then move nozzle 31 to the opening of the next tube to be cleaned using joystick 48 on controller console 42 and will feed a length of hose 28 downwardly into bore 20 of that second tube in the manner previously described.

When the first region of tubes 16 in heat exchanger 12 have been cleaned, such as tubes 16*a*, the indexer 32 itself will be moved to a new region of heat exchanger 12 so as to be disposed over a second group of tubes and the process will be repeated until all tubes 16 in heat exchanger 12 have been cleaned. Hose 28 will then be then drawn back onto the hose reel assembly 26 in the manner previously described. All motors 246, 146, 148 will be deactivated once the cleaning operation is finished and indexer 32 will be removed from heat exchanger 12.

It will be understood that instead of the device being used to rotate the hose and thereby rotate the nozzle, the device of the present invention may also be utilized to feed a static hose with a nozzle that is self-rotated via the action force of the water flowing therethrough. In this latter instance, the outer drum will not be rotated during cleaning operations. The advantage of rotating the outer drum of the present invention to rotate the nozzle is that the speed of nozzle rotation is controllable by controlling the rotation of the outer drum. The operator can therefore control the nozzle speed to a fairly precise degree. The self-rotating nozzle, on the other hand, provides far more limited control of the nozzle speed on the part of the operator and therefore limits the cleaning potential of this arrangement of the device. The operator's control is more limited because it is the pressure and flow of the water through the nozzle that determines the speed of the device and the operator has limited control over that water pressure and flow rate.

It should further be understood that while the feed motors shown and described herein are hydraulic motors connected to a hydraulic system and the rotation motor is shown and described as being pneumatic, any other type of motor may be used as a feed motor and any other type of motor may be used as a rotation motor without departing from the scope of the present invention. Thus any of the feed and rotation motors may be hydraulic, pneumatic or electric and will be provided with all of the relevant connections, components and systems that would make that motor function. It will therefore be understood that the type of motor utilized in any particular function in the device of the present invention is by way of example only and should not be considered to limit the invention in any way.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention are an example and the invention is not limited to the exact details shown or described.

The invention claimed is:

1. A hose reel assembly for cleaning tubes, said assembly comprising:

a base;

an inner drum mounted on the base;

a generally tubular outer drum mounted on the base and surrounding the inner drum;

a gap defined between a longitudinally aligned peripheral wall of the inner drum and a longitudinally aligned peripheral wall of the outer drum; and wherein the gap is adapted to receive a length of hose therein; and a first motor assembly operationally engaged with the inner drum; and wherein said first motor assembly is selectively operable to rotate the inner drum about a longitudinal axis in one of a first direction and a second direction;

wherein the outer drum includes a first drum plate and a second drum plate, and the peripheral wall of the outer drum extends between the first and second drum plates and has an exterior surface and an interior surface; and wherein the first and second drum plates and the outer drum peripheral wall bound and define a first chamber;

wherein the inner drum is received within the first chamber and includes a first inner drum plate and a second inner drum plate, and the peripheral wall of the inner drum extends between the first and second inner drum plates; and wherein the first and second inner drum plates and the inner drum's peripheral wall bound and define a second chamber therein; and the first inner drum plate is disposed inwardly from and proximate to the first drum plate and the second inner drum plate is disposed inwardly from and proximate to the second drum plate, and the peripheral wall of the inner drum has an exterior surface and an interior surface, and the exterior surface of the inner drum's peripheral wall is separated from the interior surface of the outer drum's peripheral wall by the gap;

a groove is defined in the interior surface of the outer drum's peripheral wall, said groove being adapted to receive the hose therein when the hose is disposed in the gap;

wherein the peripheral wall of the inner drum comprises a plurality of independently rotatable tubular members extending longitudinally between the first and second inner drum plates, and said tubular members are positioned at intervals around a circumferential edge of both of the first and second inner drum plates with adjacent tubular members being separated from each other by a space; and wherein two pairs of adjacent tubular members disposed opposite each other are each spaced apart by an enlarged space that is greater in circumferential size than the spaces between all other adjacent pairs of tubular members; and wherein the hose reel assembly further includes:

a feed mechanism disposed within the second chamber of the inner drum, wherein the feed mechanism is adapted to wind the length of hose disposed in the gap into an exterior surface of the inner drum's peripheral wall when the inner drum is rotated in the first direction, or to wind the length of hose off of the exterior surface of the inner drum's peripheral wall as the inner drum is rotated in the second direction; and wherein the feed mechanism includes:

a follower which engages in the groove and moves therealong to guide the hose into the groove; said follower including:

a base member having a first end and a second end; and a channel extending through the base member and through which the hose is fed when the hose is wound on to or off of the exterior surface of the inner drum's peripheral wall.

2. The hose reel assembly as defined in claim 1, further comprising:

a second motor operationally engaged with the outer drum, and wherein said second motor is selectively operable to rotate the outer drum about the longitudinal axis.

3. The hose reel assembly as defined in claim 2, wherein the first motor assembly and second motor are independently operable to simultaneously rotate the inner drum and the outer drum.

4. The hose reel assembly as defined in claim 3, wherein the inner drum and outer drum are rotated about the longitudinal axis independently and simultaneously, and both of the inner and outer drums are rotated in the first direction.

5. The hose reel assembly as defined in claim 1, wherein the first motor assembly comprises:

a first hydraulic motor;

a second hydraulic motor; each of the first and second hydraulic motors being operationally engaged with the inner drum;

a hydraulic fluid delivery system;

a first and a second fluid line linking the delivery system and the first and second hydraulic motors together; and wherein actuation of the first motor assembly selectively causes fluid to flow through the first and second fluid lines in a first fluid direction or a second fluid direction; and when the fluid flow is in the first fluid direction, the inner drum rotates in the first direction, and when the fluid flow is in the second fluid direction, the inner drum rotates in the second direction.

6. The hose reel assembly as defined in claim 1, wherein the groove is a helix.

7. The hose reel assembly as defined in claim 1, wherein the follower is movable in one of a first direction and a second direction within the second chamber; and when the follower is moved in the first direction it moves longitudinally from proximate one of the first and second inner drum plates toward the other of the first and second inner drum plates; and when the follower is moved in the second direction it moves longitudinally from proximate the other of the first and second inner drum plates to proximate the one of the first and second inner drum plates.

8. The hose reel assembly as defined in claim 2, further comprising a hose having a first end, a second end and a peripheral wall extending therebetween, wherein the hose has a longitudinal axis extending between the first and second ends thereof; and wherein the hose further defines a bore therein that is adapted to permit a pressurized flow of water therethrough; and wherein a first end of the hose is secured to an exterior surface of the outer drum and passes through an aperture in the exterior surface and into the gap between the peripheral walls of the outer and inner drums; and wherein a section of the hose including the second end, extends outwardly from the outer drum.

9. The hose reel assembly as defined in claim 8, wherein the outer drum is rotated at a speed of about 100 rpm to about 1600 rpm, and when the outer drum is so rotated, the section of the hose including the second end rotates about the hose's longitudinal axis at a speed of about 100 rpm to about 1600 rpm.

10. The hose reel assembly as defined in claim 9, wherein when the inner drum is rotated in the first direction, the hose is wound into the gap between the inner and outer drums and the section of the hose including the second end is shortened, and when the inner drum is rotated in the second direction, the hose is wound out of the gap between the inner and outer drums and the section of the hose including the second end is lengthened.

11. A system for cleaning tubes, said system comprising:
a hose reel assembly for cleaning tubes, said assembly comprising:
a base;
an inner drum mounted on the base;
an outer drum mounted on the base and surrounding the inner drum;
a gap defined between a longitudinally aligned peripheral wall of the inner drum and a longitudinally aligned peripheral wall of the outer drum; and wherein the gap is adapted to receive a length of hose therein;
a first motor assembly operationally engaged with the inner drum; and wherein said first motor assembly is selectively operable to rotate the inner drum about a longitudinal axis in one of a first direction and a second direction;
a second motor operationally engaged with the outer drum, wherein said second motor is selectively operable to rotate the outer drum about the longitudinal axis in a first direction;
a hose secured at a first end to the outer drum and including a section that extends outwardly from both of the inner and outer drums and terminates in a second end;
a feed mechanism engageable with the hose; said feed mechanism including:
a follower which engages in a groove defined in an inner surface of the outer drum and which moves therealong to guide the hose into the groove; said follower including:
a base member having a first end and a second end; and
a channel extending through the base member and through which the hose is fed when the hose is wound into or out of the groove; and wherein said inner drum is selectively rotatable in a first direction to wind at least a portion of the hose into the gap between the inner and outer drums, and the inner drum is selectively rotatable in a second direction to wind the hose out of the gap; and
a nozzle engaged with the second end of the hose; and wherein the outer drum is selectively rotatable in the first direction to cause the nozzle to rotate about a longitudinal axis of the hose.

12. The system as defined in claim 11, wherein the outer drum and therefore the nozzle is selectively rotated at a speed of about 100 rpm to about 1600 rpm.

13. The system as defined in claim 11, further comprising:
an indexer adapted to be disposed adjacent a first region of tubes, wherein the nozzle extends outwardly from the indexer and toward the first region of tubes;
a joystick provided on a controller console located remote from the tubes and being operationally connected to the indexer, said joystick being operated to selectively position the nozzle adjacent an opening to a first selected one of the tubes in the first region;
a camera mounted on the indexer and adapted to take an image of the opening of the first selected tube;
a display screen provided on the controller console positioned at a location remote from the tubes, said display screen being operationally connected to the camera and adapted to display the image thereon; and
a water delivery system operationally connected to the hose on the hose reel assembly and to the controller console, said water delivery system being activatable to provide a pressurized jet of water that flows out of the nozzle and into the opening to the first selected tube.

14. The system as defined in claim 13, wherein the water is provided at a pressure of about 10,000 psi to about 60,000 psi.

15. The hose reel assembly as defined in claim 1, wherein the follower further includes:
a first wheel mounted on the follower, and wherein at least a portion of the first wheel extends into the groove of the outer drum.

16. The hose reel assembly as defined in claim 15, further comprising a first slot provided at the first end of the base member, said first slot being oriented substantially parallel to the longitudinal axis of the base member; and wherein the first wheel is mounted for rotation in the first slot, wherein at least a portion of the first wheel extends outwardly through one of the enlarged spaces between the tubular members on the inner drum's peripheral wall and into engagement with the groove.

17. The hose reel assembly as defined in claim 16, further comprising a second slot provided at the second end of the base member, said second slot being oriented parallel to the longitudinal axis of the base member housing; and
a second wheel mounted for rotation in the second slot, at least a portion of the second wheel extending outwardly through the other of the enlarged spaces between the tubular members; and wherein the second wheel is engageable in the groove of the outer drum.

18. The hose reel assembly as defined in claim 7, wherein the follower is rotatable in one of a first direction and a second direction within the second chamber; and when the follower is rotated in the first direction it moves longitudinally from proximate one of the first and second inner drum plates toward the other of the first and second inner drum plates; and when the follower is rotated in the second direction it moves longitudinally from proximate the other of the first and second inner drum plates to proximate the one of the first and second inner drum plates.

19. A hose reel assembly comprising:
a base;
an outer drum mounted on the base;
an inner drum mounted on the base and being located within the outer drum; said inner and outer drums being separately rotatable;
a gap defined between a longitudinally aligned peripheral wall of the inner drum and a longitudinally aligned peripheral wall of the outer drum;
a groove defined in an interior surface of the peripheral wall of the outer drum;
a feed mechanism disposed within the inner drum wherein the feed mechanism includes:
a follower comprising:
a base member with a first end and a second end; where the first end engages in the groove in the outer drum; and a channel extending through the base member; and
a hose, wherein the hose extends through the channel in the base member and is wound into the groove when the inner drum and follower are rotated in a first direction; and the hose is wound out of the groove when the inner drum and follower are rotated in a second direction.

20. The hose reel assembly as defined in claim 19, wherein the first end of the base member includes a first wheel which engages in the groove in the outer drum.

21. The hose reel assembly as defined in claim 20, wherein the second end of the base member includes a second wheel which engages in the groove in the outer drum.

22. The hose reel assembly as defined in claim 19, wherein the follower is operatively engaged with the inner drum and is rotatable in unison therewith.

23. The hose reel assembly as defined in claim 19, wherein the groove is a helix.

* * * * *